US008948829B2

(12) United States Patent
Morita et al.

(10) Patent No.: US 8,948,829 B2
(45) Date of Patent: Feb. 3, 2015

(54) OXIDE SUPERCONDUCTING BULK MAGNET MEMBER

(75) Inventors: Mitsuru Morita, Tokyo (JP); Hidekazu Teshima, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 247 days.

(21) Appl. No.: 13/510,449

(22) PCT Filed: Dec. 8, 2010

(86) PCT No.: PCT/JP2010/071999

§ 371 (c)(1),
(2), (4) Date: May 17, 2012

(87) PCT Pub. No.: WO2011/071071

PCT Pub. Date: Jun. 16, 2011

(65) Prior Publication Data

US 2012/0231958 A1 Sep. 13, 2012

(30) Foreign Application Priority Data

| | | |
|---|---|---|
| Dec. 8, 2009 | (JP) | 2009-278767 |
| Dec. 8, 2009 | (JP) | 2009-278847 |
| Oct. 22, 2010 | (JP) | 2010-237471 |
| Oct. 22, 2010 | (JP) | 2010-237473 |

(51) Int. Cl.
*H01F 6/06* (2006.01)
*H01F 6/00* (2006.01)

(52) U.S. Cl.
CPC ..... *H01F 6/00* (2013.01); *Y10S 505/879* (2013.01)
USPC ..... 505/211; 505/879; 335/216; 324/318

(58) Field of Classification Search
CPC ..... H01F 6/00; H01F 6/04; H01F 6/06; H01B 12/02; H01B 12/16; H01L 39/08; H01L 39/126; H01L 39/143; H01L 39/24; H01L 39/2419; H01L 39/248; C01G 3/00; C04B 35/45
USPC ..... 505/100, 150, 211, 213, 450, 705; 335/216; 29/599; 174/125.1
See application file for complete search history.

(56) References Cited

U.S. PATENT DOCUMENTS

| | | | | |
|---|---|---|---|---|
| 6,762,664 | B2 | 7/2004 | Sander | |
| 2003/0062899 | A1 * | 4/2003 | Sander | 324/318 |

FOREIGN PATENT DOCUMENTS

| | | |
|---|---|---|
| CN | 101512829 | 8/2009 |
| JP | 62-135359 | 8/1987 |

(Continued)

OTHER PUBLICATIONS

Japanese Notice of Allowance, dated Jan. 8, 2013, issued in corresponding Japanese Application No. 2011-103177, and an English translation thereof.

(Continued)

*Primary Examiner* — Stanley Silverman
*Assistant Examiner* — Kallambella Vijayakumar
(74) *Attorney, Agent, or Firm* — Kenyon & Kenyon LLP

(57) ABSTRACT

An oxide superconducting bulk magnet member includes a plurality of bulk sections that have outer circumferences with outer circumferential dimensions different from each other and are disposed in a manner such that among the outer circumferences, an outer circumference in which the outer circumferential dimension is relatively large surrounds a small outer circumference; and interposed sections that are disposed between a pair of the bulk sections that are adjacent to each other, wherein a gap is formed between the bulk sections adjacent to each other, each of the bulk sections is an oxide bulk in which an $RE_2BaCuO_5$ phase is dispersed within an $REBa_2Cu_3O_{7-x}$ phase, and a bulk section having the smallest outer circumferential dimension among the bulk sections has a columnar shape or a ring shape, and bulk sections other than the bulk section having the smallest outer circumferential dimension have a ring shape.

11 Claims, 12 Drawing Sheets

(56) References Cited

FOREIGN PATENT DOCUMENTS

| | | | | |
|---|---|---|---|---|
| JP | 05-270828 | | 10/1993 | |
| JP | 06-020837 | | 1/1994 | |
| JP | 06-168823 | | 6/1994 | |
| JP | 07-211538 | | 8/1995 | |
| JP | 07-245211 | | 9/1995 | |
| JP | 09-255333 | | 9/1997 | |
| JP | 09-260129 | | 10/1997 | |
| JP | 09-275009 | | 10/1997 | |
| JP | 10-012429 | | 1/1998 | |
| JP | 11-186024 | | 7/1999 | |
| JP | 11335120 | * | 12/1999 | ..... C01G 3/00 |
| JP | 2001-358007 | | 12/2001 | |
| JP | 2004-503115 | | 1/2004 | |
| JP | 2006-319000 | * | 11/2006 | ..... H01F 6/04 |
| JP | 2006-332577 | | 12/2006 | |

OTHER PUBLICATIONS

Chinese Office Action dated Sep. 2, 2013 issued in corresponding CN Application No. 201080055095.7 [With English Translation of Search Report].

International Search Report dated Mar. 8, 2011, issued in corresponding PCT Application No. PCT/JP2010/071999.

Ikuta et al., "Application of High-Temperature Superconductors as Strong Quasi-Permanent Magnets", The Magnetic Soc. Jpn.V 23, No. 4-1, 1999, pp. 885-892.

Itoh et al., "High-Temperature Superconducting Motor Using Y—Ba—Cu—O Bulk Magnets" Jpn. J. Appl. Phys., vol. 34(1995), p. 5574-5578.

Morita et al., "Processing and Properties of Oxide-Superconductor Bulk Magnet" Journal of the Magnetics Society of Japan, vol. 19(1995), No. 3, p. 744-747.

* cited by examiner

OXIDE SUPERCONDUCTING BULK MAGNET MEMBER

FIELD OF THE INVENTION

The present invention relates to an oxide superconducting bulk magnet member.

This application is a national stage application of International Application No. PCT/JP2010/071999, filed Dec. 8, 2010, which claims priority to Japanese Patent Application No. 2009-278847, filed Dec. 8, 2009, Japanese Patent Application No. 2009-278767, filed Dec. 8, 2009, Japanese Patent Application No. 2010-237471, filed Oct. 22, 2010, and Japanese Patent Application No. 2010-237473, filed Oct. 22, 2010, the contents of which are incorporated herein by reference.

DESCRIPTION OF RELATED ART

A bulk of an oxide superconductor in which an $RE_2BaCuO_5$ phase is dispersed within an $REBa_2Cu_3O_{7-x}$ phase (RE is a rare earth element) has a high critical current density ($J_c$), such that when being excited by a magnetization method such as cooling in a magnetic field (magnetic cooling) and a pulse magnetization, the bulk may be used as an oxide superconducting bulk magnet. For example, in Patent Citation 1, a superconducting magnetic field generating apparatus, which allows the oxide superconductor (oxide bulk superconductor) to be used to a superconducting motor or the like, is disclosed.

In Non-Patent Citation 1, a bulk magnet, which can generate a magnetic field of substantially 1.5 T to the maximum by using a columnar Sm-based bulk superconductor with a diameter of 36 mm that is magnetized by a magnetic cooling, is disclosed. In addition, in Non-Patent Citation 2, a pulse magnetization and magnetization by a magnetic cooling are compared and examined by using a Y-based bulk superconductor. Furthermore, in Non-Patent Citation 3, a magnetic field of substantially 4.5 T is generated at 40 K by using a bulk superconductor with a diameter of substantially 60 mm in a superconducting magnet. In regard to a pulse magnetization of the RE-based bulk superconductor, in Patent Citation 1, a pulse magnetization accompanied with magnetic flux jump is disclosed, and in Patent Citation 2 and Patent Citation 3, for example, a magnetization method including a cooling method is disclosed.

In recent years, in Patent Citation 4, a superconducting bulk magnet in which a large trapped magnetic field from a low magnetic field to a high magnetic field can be obtained is disclosed. In this superconducting bulk magnet, two kinds of RE-based superconducting bulk materials ($RE^{I}Ba_2Cu_3O_{7-x}$ and $RE^{II}Ba_2Cu_3O_{7-x}$) are used. That is, in the superconducting bulk magnet, a columnar bulk superconductor ($RE^{I}Ba_2Cu_3O_{7-x}$) that has a high $J_c$ characteristic in a high magnetic field is disposed at an inner side of a ring-shaped bulk superconductor ($RE^{II}Ba_2Cu_3O_{7-x}$) that has a high critical current density ($J_c$) characteristic in a low magnetic field. In addition, magnetization of this superconducting bulk magnet is performed under a static magnetic field.

In addition, in Patent Citation 5, a superconducting bulk magnet in which two kinds of or three kinds of RE-based superconducting bulk materials having compositions different from each other (that is, having superconductivity characteristics different from each other) are disposed and a large trapped magnetic field from a low magnetic field to a high magnetic field can be obtained is disclosed. Specifically, two kinds of (or three kinds of) superconducting bulks having critical current density characteristics different from each other are used, a material having a large critical current density in a low magnetic field is disposed at the peripheral portion of the superconducting bulk magnet, and a material having a high current density in a high magnetic field is disposed at a central portion in which a magnetic field strength is high. By this disposition, it is possible to generate a strong magnetic field over the entirety of the superconducting bulk magnet. In Patent Citation 5, a static magnetic field magnetization method and a pulse magnetization method are disclosed as the magnetization method.

In Patent Citation 6, a hollow oxide superconducting bulk magnet (a superconducting bulk magnet in which a plurality of hollow oxide superconducting bulks are combined) is disclosed. Material-saving and a reduction in weight may be achieved with this oxide superconducting bulk magnet. In addition, in order to use the superconducting bulk magnet as a permanent magnet by magnetizing the superconducting bulk magnet, a method in which the superconducting bulk magnet is dipped into liquid nitrogen to set a superconducting state, and a magnetic field is applied from the outside to make lines of magnetic flux be trapped in the superconductor, that is, a static magnetic field magnetization method is used. In addition, in Patent Citation 7, a method in which in order to solve a problem of a characteristic deterioration due to heat generation in the pulse magnetization, a passage of coolant is provided between superconductors to improve a trapped magnetic flux characteristic at the time of the pulse magnetization is disclosed.

As described above, in the RE-based (RE-Ba—Cu—O-based) oxide bulk, a configuration of an oxide superconducting bulk as the bulk magnet and the magnetization method are modified to improve the magnetic field strength of the magnet.

Patent Citation

[Patent Citation 1] Japanese Unexamined Patent Application, First Publication No. H6-20837

[Patent Citation 2] Japanese Unexamined Patent Application, First Publication No. H6-168823

[Patent Citation 3] Japanese Unexamined Patent Application, First Publication No. H10-12429

[Patent Citation 4] Japanese Unexamined Patent Application, First Publication No. 2001-358007

[Patent Citation 5] Japanese Unexamined Patent Application, First Publication No. H9-255333

[Patent Citation 6] Japanese Unexamined Patent Application, First Publication No. H7-211538

[Patent Citation 7] Japanese Unexamined Patent Application, First Publication No. 2006-319000

Non-Patent Citation

[Non-Patent Citation 1] Journal of the Magnetics Society of Japan, Vol. 23 (1999), No. 4-1, p. 885

[Non-Patent Citation 2] Jpn. J. Appl. Phys., Vol. 34 (1995), P. 5574

[Non-Patent Citation 3] Journal of the Magnetics Society of Japan, Vol. 19 (1995), No. 3, p. 744

SUMMARY OF THE INVENTION

Problems to be Solved by the Invention

The oxide bulk in which an $RE_2BaCuO_5$ phase (211 phase) is dispersed within an $REBa_2Cu_3O_{7-x}$ phase (123 phase) is mainly manufactured by crystal-growing a seed crystal of several mm square into a single crystal-like bulk. The 123 phase during the crystal growth has a tetragonal system, such that when being brought into contact with an a-b plane of an arbitrary crystal by a common seeding method, the 123 phase grows while forming facet planes with four-fold symmetry within a seeding plane. A superconducting characteristic of the oxide bulk manufactured by the crystal growth in this manner generally has a non-uniformity of four-fold symmetry. As a specific example, a trapped magnetic flux distribution, which can be obtained by magnetizing a disk-shaped oxide bulk with a static magnetic field magnetization, is shown in FIG. 13. As shown in FIG. 13, the trapped magnetic flux distribution is deviated from a concentric circle and is distorted with four-fold symmetry. That is, as described above, the oxide bulk in which the 211 phase is dispersed within the 123 phase may be used as a bulk magnet, but as shown in FIG. 13, since the magnetic flux distribution is distorted, in a case where this oxide bulk is actually used as a magnet of a magnetic levitation device, a superconducting motor, a superconducting generator, or the like, a driving or a power generation with good efficiency may be difficult.

In the superconducting bulk magnet using RE-Ba—Cu—O-based oxide bulk as described above, an improvement in magnetic field strength has been focused in the conventional techniques. In this manner, in a case where the bulk magnet simply having high magnetic field strength is assembled into a superconducting motor, a superconducting generator, or the like that is actually used, since the magnetic flux distribution (magnetic field strength distribution) of the bulk magnet is non-uniform, the driving or power generation with good efficiency may be difficult. Therefore, when the oxide bulk is used as the superconducting bulk magnet, it is important to make the magnetic flux distribution uniform (for example, concentrically uniform) without being distorted.

On the other hand, in the technology disclosed in Patent Citation 5, as a superconducting bulk magnet using the RE-Ba—Cu—O-based oxide bulk described above, for example, a Y-based oxide bulk superconductor having a large critical current density in a low magnetic field is provided at a peripheral portion of the bulk magnet, and an Nd-based oxide bulk superconductor having a large critical current density in a high magnetic field is provided at a central portion of the bulk magnet to obtain a strong magnetic field. However, there is no description and suggestion with respect to such things as it is important to obtain a uniform magnetic field as the superconducting bulk magnet, and the configuration thereof is not illustrated. In addition, as a method of obtaining a strong and uniform magnetic field, there is disclosed a configuration in which a plurality of ring-shaped grooves are provided in a doughnut-shaped copper plate, and the RE-Ba—Cu—O-based oxide bulk is embedded in these grooves. However, the magnet with this configuration is a coil magnet that is used as a superconducting coil not the bulk magnet, such that an occupancy ratio of the copper plate that is a supplementary material in the entirety of the magnet increases. Therefore, in this coil magnet, the ratio of a generated magnetic field strength with respect to a magnet mass decreases.

The superconducting bulk magnet using the RE-Ba—Cu—O-based oxide bulk described above is light compared to the conventional magnets such as a metallic magnet or an electromagnet that uses a coil. In Patent Citation 6, a plurality of hollow bulk superconductor are combined in a manner such that a central portion of the bulk magnet becomes hollow, so that the superconducting bulk magnet becomes relatively light through a reduction in a used amount of a raw material, and a superconducting current does not flow to an unnecessary portion. However, there is no description or suggestion with respect to such things as it is important in practical use to make the magnetic flux distribution of the bulk magnet uniform, and a configuration thereof is not illustrated.

In addition, in the technology disclosed in Patent Citation 6, since the superconducting bulk magnet is made to be light by reducing the used amount of a raw material, a superconductor is not present at the central portion of the superconducting bulk magnet. Therefore, in this structure, the hollow section becomes relatively large, and the ratio of the inner diameter of the hollow section to the external diameter of the bulk magnet becomes 46.7% or 33.3%. Even in the superconducting bulk magnet having such a large hollow section, it is not necessary for the magnet flux distribution to be made uniform. Particularly, the superconducting bulk magnet may not maintain the uniform magnetic flux distribution under an environment in which the superconductor bulk magnet is actually used as a magnet of a rotating or moving equipment such as a magnetic levitation device, a superconducting motor, a superconducting generator, or the like. Furthermore, in Patent Citation 6, a description was given as if the superconducting bulk magnet has substantially the same performance as a superconducting bulk magnet in which the inside thereof is also filled, regardless of the presence of the hollow section. However, since the superconductor inside the bulk magnet makes a finite contribution, in the superconducting bulk magnet in which the hollow section is formed, a characteristic (magnetic field strength) deteriorates compared to the bulk magnet in which the inside thereof is also filled. Particularly, a difference in this characteristic becomes significant in a case where a comparison is made with a strong magnetic field strength, and also becomes significant depending on a magnetization method.

In order to magnetize the oxide superconducting bulk magnet using the RE-Ba—Cu—O-based oxide bulk described above, a magnetization method such as a static magnetic field magnetization method or a pulse magnetization method is used. Particularly, in a case where the oxide superconducting bulk magnet is simply magnetized while being assembled into an apparatus, it is preferable to use a pulse magnetization method in order for the superconducting bulk magnet to have a strong magnetic field. However, in the pulse magnetization method, in the case of being magnetized so as to obtain a strong magnetic field, the magnetic flux distribution becomes non-uniform, such that there is a problem in that a uniform magnetic flux distribution may not be obtained. The reason therefor will be described below.

The pulse magnetization method is a magnetization method accompanied with a rapid variation in a magnetic field, such that magnetic flux rapidly moves within the superconductor at the time of magnetization, and thereby a large quantity of heat is generated in the superconductor. Therefore, the generated heat increases a temperature at a portion thereof (heat generation portion), and when a superconducting characteristic of this portion is deteriorated, the movement of the magnetic flux occurs more easily. In addition, even when a slight characteristic non-uniformity occurs in the superconductor, such a cycle (a cycle of movement of magnetic flux, heat generation, increase of a temperature, and deterioration of a superconducting characteristic) is repeated, and thereby the non-uniformity of the characteristic is enhanced, and the trapped magnetic flux distribution becomes non-uniform. For example, in a case where a general disk-shaped oxide superconducting bulk magnet member is magnetized and is used as the bulk magnet, when a material characteristic is completely uniform, a superconducting current flows in the form of concentric circles of the disk (the oxide superconducting bulk magnet member). In this case, when a magnetic flux density is taken in the height direction of the disk, a conical magnetic density distribution may be obtained. However, in a practical material, it is difficult to industrially obtain a completely uniform material characteristic, and in the pulse magnetization method, the conical uniform magnetic flux density distribution may not be obtained. Furthermore, in a case where the magnetization is performed according to the pulse magnetization method, the larger the speed variation of an applied magnetic field and the magnetic field strength are, the more easily and significantly the non-uniformity of the magnetic flux distribution occurs. The larger the size of the superconductor is or the higher the $J_c$ characteristic is, the more easily and significantly the non-uniformity of the magnetic flux distribution occurs. Therefore, the lower the temperature is, the higher the $J_c$ characteristic becomes, such that there is a tendency in that the lower the cooling temperature is, the more the trapped magnetic flux distribution becomes non-uniform.

In Patent Citation 5, an example in which the magnetization is performed using the pulse magnetization method as described is disclosed. However, in Patent Citation 5, the realization of only the superconducting magnet with a strong magnetic field is illustrated, and the uniformity of the magnetic field is not illustrated. In addition, in Patent Citation 6, as described above, the magnetization is performed by only the static magnetic field magnetization method, and the uniformity of the magnetic field according to the pulse magnetization method is not illustrated. In this manner, in the structure disclosed in Patent Citation 5 and Patent Citation 6, in the case of performing the pulse magnetization, it is difficult to obtain a uniform magnetic field with good reproduction, or to obtain a strong magnetic field in a uniform manner.

In addition, in the pulse magnetization method, as described above, since the magnetic field rapidly varies during magnetization, in the oxide superconducting bulk magnet member in which a plurality of RE-Ba—Cu—O-based oxide bulks are disposed, accompanying the rapid variation of the magnetic field, a rapid variation in stress with respect to each oxide bulk and strain accompanying this occur. Therefore, there is a problem in that a part of the plurality of oxide bulks are broken due to repetition of such a variation in stress, and as a result thereof, a strong magnetic field and a uniform magnetic field may not be obtained.

In addition, in regard to the oxide superconducting bulk magnet member in which the plurality of RE-Ba—Cu—O-based oxide bulks are disposed, when being used as a magnet of a rotary machine such as a superconducting generator, a superconducting motor, or the like, the oxide superconducting bulk magnet member receives centrifugal force or vibration, such that each of the oxide bulks may gradually move. In this case, the plurality of oxide bulks are easily broken, as well as the disposed position of each of the oxide bulks is deviated, such that there is a problem in that the original strong and uniform magnetic field may not be maintained.

The present invention has been made in consideration of the above-described problems, and an object of the present invention is to provide an oxide superconducting bulk magnet member that can be used as a superconducting bulk magnet having a symmetrically uniform magnetic field in a strong magnetic field even when the oxide superconducting bulk magnet member is repeatedly magnetized by a pulse magnetization method. Particularly, the object of the present invention is to provide an oxide superconducting bulk magnet member which may be easily manufactured using an oxide bulk (for example, an oxide bulk in which an $RE_2BaCuO_5$ phase is dispersed within an $REBa_2Cu_3O_{7-x}$ phase) and in which a symmetrical and uniform magnetic field may be obtained stably in a strong magnetic field even when the oxide superconducting bulk magnet member is used as a magnet of a rotary machine such as a superconducting generator, a superconducting motor, or the like.

Methods for Solving the Problem

The present inventors have found that when an oxide superconducting bulk magnet member is manufactured using oxide bulks in which an $RE_2BaCuO_5$ phase is dispersed within an $REBa_2Cu_3O_{7-x}$ phase, and a plurality of oxide bulks (bulk sections) are disposed to be a nested structure, even when a magnetic field rapidly varies during a pulse magnetization, disturbance in a superconducting current may be suppressed, and therefore a magnetic field that is symmetrical and uniform in a strong magnetic field may be obtained. In addition, the present inventors have found that when a specific interposed sections (for example, a resin, grease, solder, or a joint) is disposed between a plurality of oxide bulks that are disposed, even when pulse magnetization is performed repeatedly, breakage of the oxide bulks may be reduced, and therefore a strong and uniform magnetic field may be obtained with a good reproduction.

That is, the overview of the present invention is as follows.

(1) An oxide superconducting bulk magnet member according to an aspect of the present invention includes a plurality of bulk sections that have outer circumferences with outer circumferential dimensions different from each other and are disposed in a manner such that among the outer circumferences, an outer circumference in which the outer circumferential dimension is relatively large surrounds a small outer circumference; and interposed sections that are disposed between a pair of the bulk sections that are adjacent to each other, wherein a gap is formed between the bulk sections adjacent to each other, each of the bulk sections is an oxide bulk in which an $RE_2BaCuO_5$ phase is dispersed within an $REBa_2Cu_3O_{7-x}$ phase, and a bulk section having the smallest outer circumferential dimension among the bulk sections has a columnar shape or a ring shape, and bulk sections other than the bulk section having the smallest outer circumferential dimension have a ring shape.

(2) In the oxide superconducting bulk magnet member according to the above (1), the interposed sections may be formed of a resin, grease, or solder, and a width dimension of the gap between the pair of bulk sections that are adjacent to each other may be 0.01 mm or more and 0.49 mm or less.

(3) In the oxide superconducting bulk magnet member according to the above (2), the pair of bulk sections that are adjacent to each other may be different in an a-axis direction of the $REBa_2Cu_3O_{7-x}$ phase.

(4) In the oxide superconducting bulk magnet member according to the above (1), the interposed sections may be formed of the oxide bulk to be a bridge portion that connects the pair of bulk sections that are adjacent to each other.

(5) In the oxide superconducting bulk magnet member according to the above (4), the width dimension of the bridge portion along an outer circumference of an inner side bulk section among the pair of bulk sections that are adjacent to each other may be 0.1 mm or more, and may be 25% or less of the outer circumferential dimension of the outer circumference.

(6) In the oxide superconducting bulk magnet member according to the above (4), a thickness dimension of each of the bulk sections in the direction of a rotational symmetry axis may be 1.0 mm or more and 5.0 mm or less.

(7) The oxide superconducting bulk magnet member according to the above (4) may further include a resin, grease, or solder in at least a part of the gap.

(8) In the oxide superconducting bulk magnet member according to the above (2) or (4), a maximum dimension of the width of the ring-shaped bulk sections among the bulk sections in a direction orthogonal to the rotational symmetry axis may exceed 1.0 mm and be 20.0 mm or less.

(9) In the oxide superconducting bulk magnet member according to the above (2) or (4), a shape of an inner circumference and a shape of an outer circumference of each of the ring-shaped bulk sections among the bulk sections may be a polygonal, circular, or racetrack shape.

(10) In the oxide superconducting bulk magnet member according to the above (2) or (4), the bulk sections may be stacked to form a plurality of layers in the direction of the rotational symmetry axis.

(11) In the oxide superconducting bulk magnet member according to the above (10), a c-axis of the $REBa_2Cu_3O_{7-x}$ phase in each of the layers may be within a range of ±30° with respect to the rotational symmetry axis.

(12) In the oxide superconducting bulk magnet member according to the above (10), layers, which are adjacent to each other, among the layers may be different in the a-axis direction of the $REBa_2Cu_3O_{7-x}$ phase.

Effects of the Invention

According to the present invention, it is possible to provide an oxide superconducting bulk magnet member that can stably generate a strong and uniform magnetic field by being magnetized with a pulse magnetization method. In addition, it is possible to provide an oxide superconducting bulk magnet member that may be magnetized with excellent symmetry property and uniformity. Furthermore, even when the pulse magnetization is repeated, the occurrence of breakage of the oxide bulk may be reduced, such that a strong and uniform magnetic field may be obtained with good reproduction. Since an oxide superconducting bulk magnet that generates a high magnetic field may be realized by the pulse magnetization method in a relatively simple manner, a high magnetic field, which is not obtained in a common permanent magnet, may be used, thereby resulting in a significant industrial effect.

In the oxide superconducting bulk magnet member according to the above (4), since a process of assembling and disposing oxide bulks to form the nested structure may be partially or entirely omitted, a process of manufacturing the oxide superconducting bulk magnet member may be easy. Particularly, in a case where ring-shaped sections (ring-shaped bulk sections) are relatively thin, and the number of layers (the number of layers) of the ring-shaped sections is large, a bridge portion gives a large merit in productivity.

DETAILED DESCRIPTION OF THE INVENTION

The inventors found that in order to use an oxide superconducting bulk magnet member (a superconducting magnet) using an RE-Ba—Cu—O-based oxide bulk as an oxide superconducting bulk magnet in which a magnetic field is strong, symmetrical and uniform after magnetizing by a pulse magnetization method, it is effective to reduce a disturbance of a superconducting current in the bulk magnet member by restricting movement of magnetic flux during the pulse magnetization. In addition, the inventors found that the movement of the magnetic flux during the pulse magnetization may be easily restricted by disposing the oxide bulk to form a nested structure. A current rarely flows between the oxide bulks (bulk sections) that are disposed in a nested structure, such that the superconducting current flows within each of the oxide bulks, and therefore the disturbance of the superconducting current becomes small. That is, an oxide superconducting bulk magnet in which the magnetic field is strong, symmetrical and uniform may be obtained by the pulse magnetization method.

First Embodiment

Figure 1A:
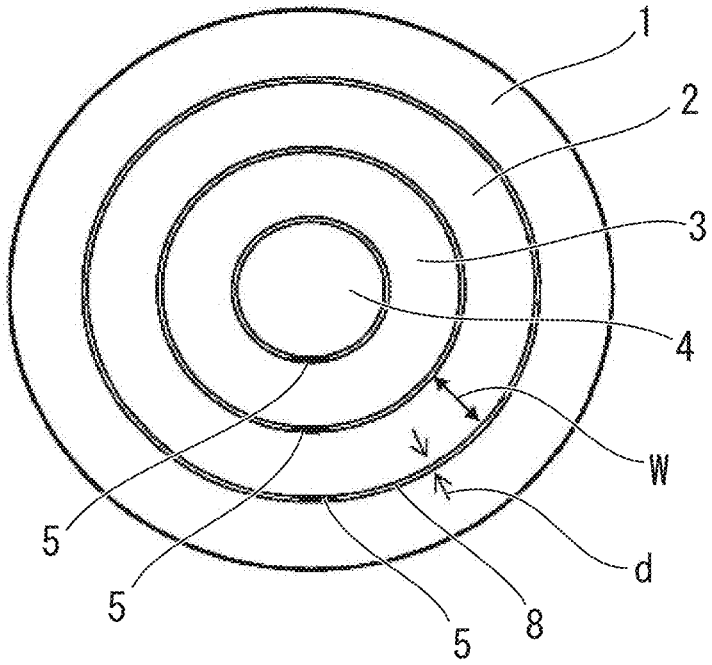
FIG. 1A is a top plan view illustrating a structure example in which a plurality of bulk sections are disposed to form a nested structure.
Figure 1B:
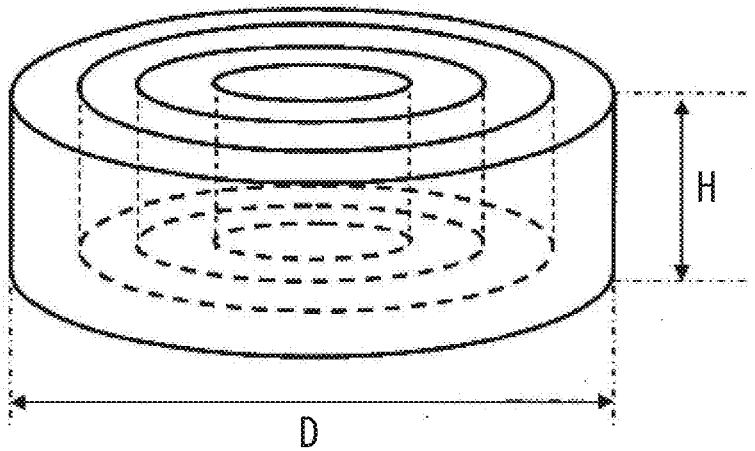
FIG. 1B is a perspective view illustrating the structure example in which the plurality of bulk sections are disposed to form the nested structure.

In the oxide superconducting bulk magnet member according to a first embodiment of the present invention, as shown in FIGS. 1A and 1B, an RE-Ba—Cu—O-based oxide bulks (a plurality of bulk sections) are disposed to form a nested structure. In this embodiment, since this disposition structure is provided, in a case where a strong magnet is obtained by the pulse magnetization method, even when the magnetic field rapidly varies during the pulse magnetization, the movement of the magnetic flux may be restricted and therefore the strong and uniform magnetic field may be obtained.

In FIGS. 1A and 1B, three ring-shaped RE-Ba—Cu—O-based oxide bulks (ring-shaped bulk section, ring sections) 1 to 3 which are different in size, and one columnar RE-Ba—Cu—O-based oxide bulk (columnar bulk section, core section) 4 are disposed to form a nested structure. In such a disposition structure, since a gap 8 is provided between the oxide bulks, when the pulse magnetization is performed, the movement of the magnetic flux during the pulse magnetization is restricted so that a magnetic field distribution in the oxide bulks is uniformly symmetrical. Therefore, the disturbance of the superconducting current that flows in the bulk magnet member may be reduced. As a result, an oxide superconducting bulk magnet in which the magnetic field is strong, symmetrical and uniform can be obtained. In addition, as shown in FIG. 1A, at least a part of the gap 8 is further provided with a buffer material (interposed section) 5 such as a resin, grease, and solder.

In addition, here, the nested structure is a structure in which a plurality of oxide bulks that have outer circumferences with outer circumferential dimensions different from each other are disposed in a manner such that an outer circumference in which the outer circumferential dimension is relatively large surrounds a small outer circumference. Therefore, an oxide bulk having the smallest outer circumferential dimension among the oxide bulks has a columnar shape or a ring shape, and oxide bulks other than the oxide bulk having the smallest outer circumferential dimension have a ring shape. Furthermore, a gap is formed between the oxide bulks adjacent to each other.

In addition, in regard to each of the RE-Ba—Cu—O-based oxide bulks 1 to 4, RE-Ba—Cu—O-based oxide bulks in which chemical elements corresponding to RE are same as each other may be combined, or plural kinds of RE-Ba—Cu—O-based oxide bulks in which the chemical elements corresponding to RE are different from each other may be combined. In the latter case, at least one of the RE-Ba—Cu—O-based oxide bulks 1 to 4 shown in FIGS. 1A and 1B has the chemical element corresponding to RE, which is different from that in other RE-Ba—Cu—O-based oxide bulks. For example, RE-Ba—Cu—O-based oxide bulks in which the chemical elements corresponding to RE are different from each other are prepared by combining chemical elements selected from among Sm, Eu, Gd, Dy, Y, and Ho as RE, and thereby the RE-Ba—Cu—O-based oxide bulks can be disposed to form the nested structure in which the chemical element corresponding to RE of at least one of the RE-Ba—Cu—O-based oxide bulks 1 to 4 is changed. In this case, when the composition of RE is changed while considering a $J_c$ characteristic of the RE-Ba—Cu—O-based oxide bulks, it is possible to improve an overall characteristic of the oxide superconducting bulk magnet member.

Figure 2A:
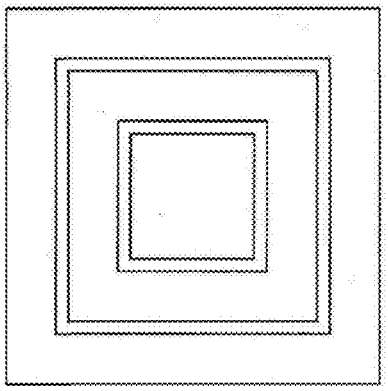
FIG. 2A is a top plan view illustrating a shape example of the plurality of bulk sections that are disposed in the nested structure.
Figure 2B:
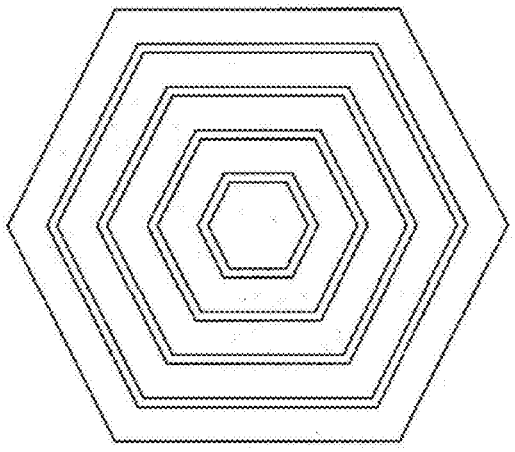
FIG. 2B is a top plan view illustrating a shape example of the plurality of bulk sections that are disposed in the nested structure.
Figure 2C:
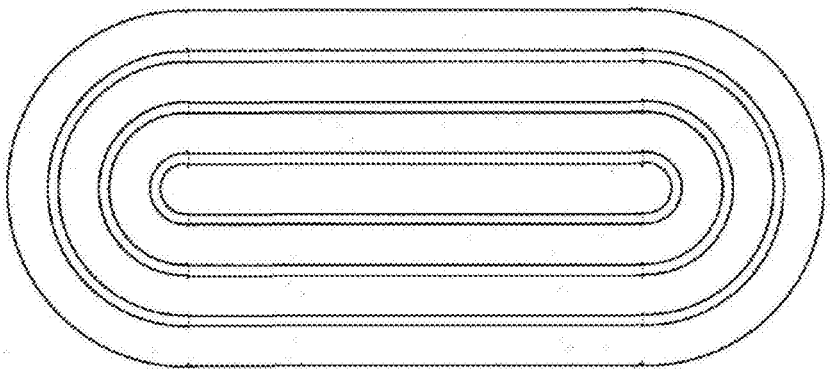
FIG. 2C is a top plan view illustrating a shape example of the plurality of bulk sections that are disposed in the nested structure.

A circumferential shape (an inner circumferential shape or an outer circumferential shape) seen from the direction of a rotational symmetry axis of the oxide bulks that are disposed to form the nested structure is a circular shape in an example shown in FIG. 1A. However, the shape may be a shape in which a gap capable of restricting the movement of the magnetic flux during the pulse magnetization from the above-described reason may be formed, and an appropriate shape may be selected so that a desired magnetic field distribution can be obtained as the oxide superconducting bulk magnet that is suitable for each use. For example, as the circumferential shape of the oxide bulk, a polygonal shape such as a triangle, a quadrilateral, a pentagon, a hexagon, a heptagon, and an octagon, a circular shape, a rectangular shape, an ellipsoidal shape, a racetrack shape, or the like may be used. In addition, as an example, oxide bulks having a quadrilateral circumferential shape is illustrated in FIG. 2A, oxide bulks having a hexagonal circumferential shape is illustrated in FIG. 2B, and oxide bulks having a racetrack-shaped circumferential shape is illustrated in FIG. 2C. From a practical use aspect, it is preferable that at least one of the oxide bulks (ring-shaped bulk sections) be a ring having a circumferential shape from a polygon of a hexagon or more to a circle, or a ring having a circumferential shape of a racetrack. When the oxide bulks have such a circumferential shape, the oxide superconducting bulk magnet member may be easily manufactured (processed, assembled), such that it is possible to obtain the magnetic field that is relatively strong and uniform. In a case where the circumferential shape is a polygonal shape, a hexagon or an octagon may be further preferable from aspects of easiness of the processing and assembling, and a performance balance in the magnetic field that may be obtained.

Figure 3A:
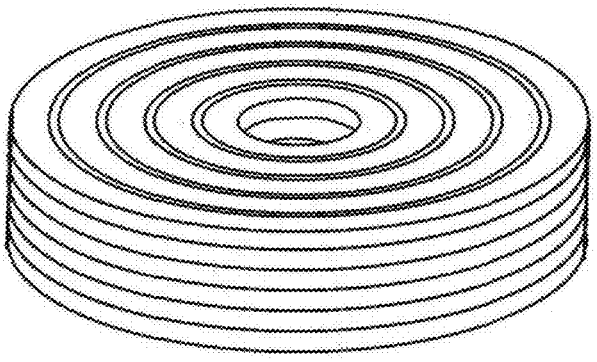
FIG. 3A is a perspective view illustrating a structure example in which the plurality of bulk sections are stacked in the direction of a rotational symmetry axis.
Figure 3B:
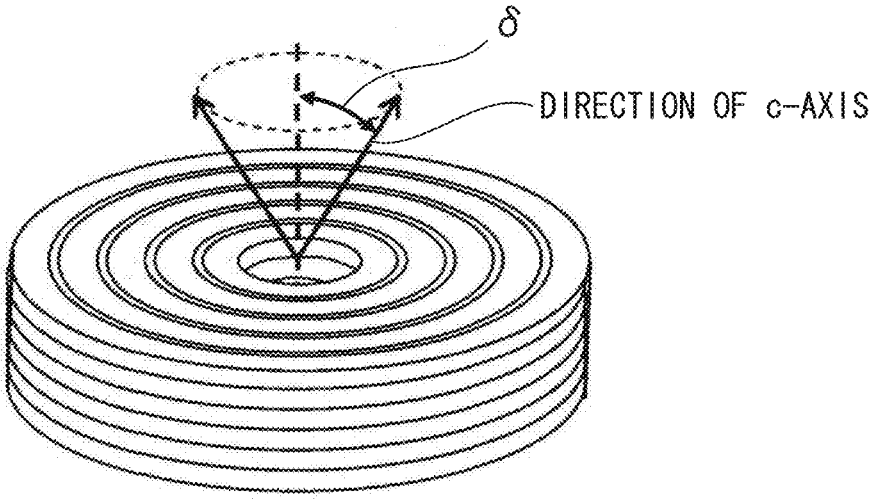
FIG. 3B is a perspective view illustrating a state in which the plurality of bulk sections are stacked in the direction of the rotational symmetry axis, and a c-axis of an 123 phase is present within a range of ±30° (δ) with respect to the rotational symmetry axis.

In addition, it is preferable that the oxide bulks (group of the bulk sections) that are disposed to form a nested structure be stacked to form a plurality of layers in the direction of a rotational symmetry axis. For example, when a plurality of oxide superconducting bulk magnet members shown in FIG. 1A are prepared and stacked, it is possible to obtain a relatively strong magnetic field. FIGS. 3A and 3B illustrate an example in which the oxide bulks are stacked to form six layers.

Here, FIG. 3A shows an example in which a core section of the nested structure is not provided (hollow). In this case, the innermost circumferential oxide bulk having the smallest outer circumferential dimension has a ring shape. However, when the innermost circumferential oxide bulk of the nested structure has a columnar shape (solid) shown in FIG. 1A, it is possible to stably generate a strong magnetic field compared to the case of the ring shape (hollow) (in a case where a core portion is absent). When the superconducting magnet of the nested structure in which the core section is not provided is used as a magnet of a rotary machine such as a superconducting generator and a superconducting motor, an inner diameter of the hollow section (an inner diameter of the innermost circumferential oxide bulk of the nested structure) with respect to an outer diameter (an outer diameter of the outermost circumferential oxide bulk of the nested structure) of the superconducting magnet is preferably 30% or less (9% or less in an area ratio), more preferably 20% or less (4% or less in the area ratio), and most preferably 10% or less (1% or less in the area ratio). The lower limit of the inner diameter of the hollow section is 0%.

In a case where the stacking is performed in this way, it is possible to increase a symmetrical property and a uniformity of the magnetic field over the entirety of the oxide superconducting bulk magnet. In the oxide bulk, a probability of including defects, which decrease a current density in an a-axis direction of a seed crystal during a crystal growth stage, may be raised. Therefore, it is more preferable that the layers be disposed in a manner such that an a-axis or b-axis direction of the $REBa_2Cu_3O_{7-x}$ crystal ($REBa_2Cu_3O_{7-x}$ phase) is different between a layer of a stacked oxide bulk (a core section and a ring section in the layer) and two layers (core sections and ring sections in the layers) that are vertically adjacent to the layer. A deviation in the a-axis or b-axis direction between the layers is more preferably 5° to 40°. In this manner, when the layers are disposed in a manner such that the a-axis or b-axis direction of the $REBa_2Cu_3O_{7-x}$ phase in adjacent layers among the layers is different in each case, it is possible to make a low-characteristic portion not parallel between layers, such that a characteristic of the entirety of the superconducting bulk magnet may be uniform. A superconducting junction or a normal conducting junction may be made between the stacked oxide bulks (between layers) as long as the above-described effect may be obtained.

In this embodiment, as described above, RE-Ba—Cu—O-based oxide bulks, that is, oxide bulks in which an $RE_2BaCuO_5$ phase is dispersed within an $REBa_2Cu_3O_{7-x}$ phase may be used. However, since a relative large superconducting current may be made to flow to an a-b plane of the $REBa_2Cu_3O_{7-x}$ phase in the oxide bulks, it is preferable that the oxide bulks be disposed in a manner such that magnetic flux go through vertically with respect to the a-b plane and are magnetized. Therefore, it is preferable that a c-axis of the $REBa_2Cu_3O_{7-x}$ crystal of each oxide bulk (one layer) match a rotational symmetry axis of the oxide bulk (a rotational symmetry axis of the oxide superconducting bulk magnet member). Furthermore, in a case where the plurality of layers of the oxide bulks that are disposed to form the nested structure are stacked in the direction of the rotational symmetry axis, as shown in FIG. 3B (angle δ), it is more preferable that the c-axis of the $REBa_2Cu_3O_{7-x}$ crystal in each layer be within a range of ±30° with respect to the rotational symmetry axis of each of the oxide bulks, because a strong magnetic field may be obtained. In addition, it is more preferable that each c-axis be within a range of ±10° with respect to the rotational symmetry axis. In addition, when the angle δ is within a range of ±30°, a strong magnetic field may be obtained with a good reproduction. The lower limit of the angle δ is ±0°.

Figure 4:
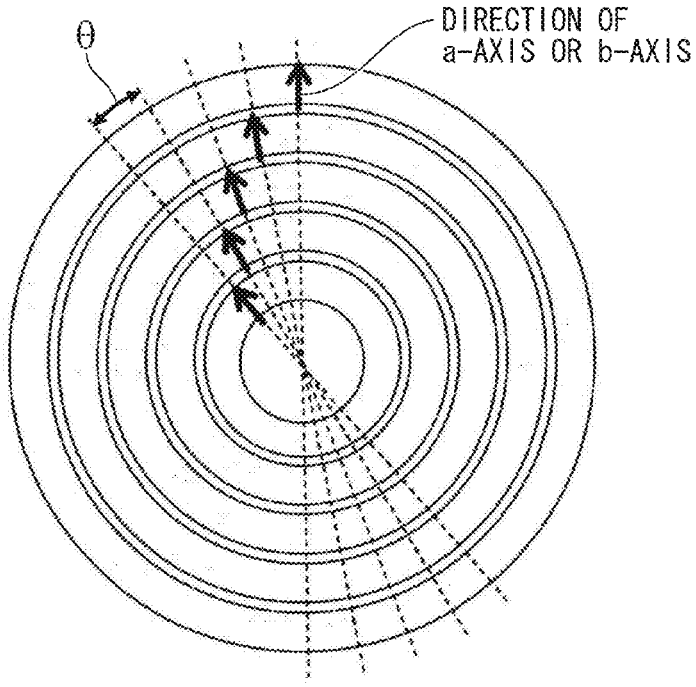
FIG. 4 is a top plan view illustrating a configuration example in which disposition is performed to realize the nested structure in a manner such that an a-axis of $REBa_2Cu_3O_{7-x}$ crystal in each of the bulk sections faces a different direction in each case.

In addition, it is more preferable that the disposition be performed in a manner such that the a-axis direction of the $REBa_2Cu_3O_{7-x}$ crystal in the oxide bulks that are adjacent in a nested structure in a direction orthogonal to the rotational symmetry axis is different in each case, because a relatively uniform magnetic flux may be obtained. An example thereof is illustrated in FIG. 4. It is more preferable that a deviation θ of the a-axis (or b-axis) direction of the oxide bulks be ±5° or more and ±40° or less. For example, as shown in FIG. 3A, in a case where a plurality of layers are stacked, it is preferable that the layers be stacked in a manner such that the a-axis direction of the $REBa_2Cu_3O_{7-x}$ crystal in the oxide bulks of layers that are adjacent vertically (in a stacking direction) is different in each case, because a relatively uniform magnetic flux may be obtained. In this case, it is preferable that a deviation of each a-axis direction in the stacking direction (the direction of the rotational symmetry axis) be ±5° or more and ±40° or less. Furthermore, the number of layers of the nested structure is two or more so as to form the nested structure. In the example of FIG. 1A, since the RE-Ba—Cu—O-based oxide bulks 1 to 4 are disposed in the nested structure, such that the number of layers is four. Here, it is preferable that the larger the oxide superconducting bulk magnet member becomes, the larger the number of layers is. Normally, in order to obtain a relatively strong and uniform magnetic field by performing the pulse magnetization, the number of layers is preferably four or more, and more preferably five or more.

Figure 14A:
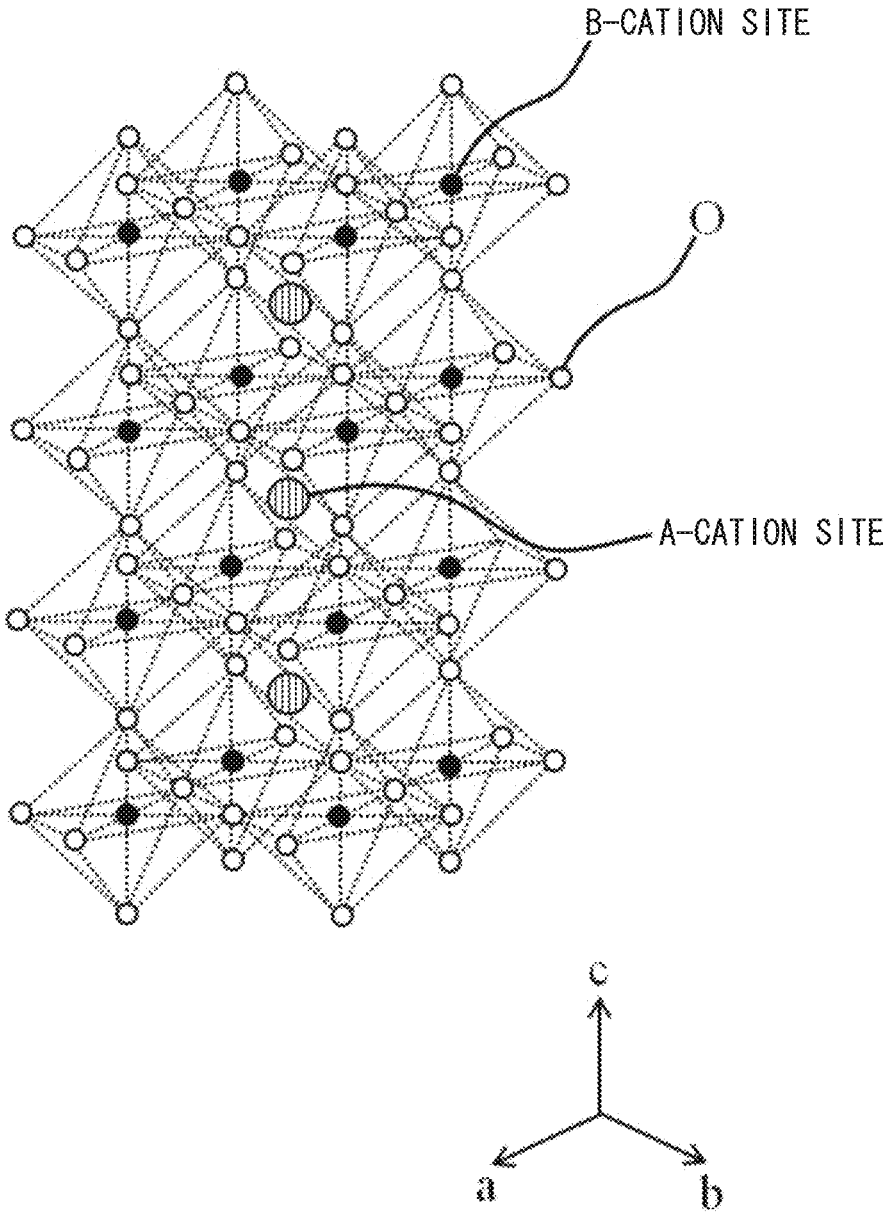
FIG. 14A is a view illustrating a-axis, b-axis, and c-axis of a perovskite structure.

In addition, the above-described a-axis, b-axis, and c-axis are determined by a crystal orientation in conformity to a perovskite-type structure shown in FIG. 14A. That is, the a-axis and b-axis are in directions in the bottom surface of a quadrangular pyramid included in an octahedron that is configured by oxygen ions, and the c-axis is in a direction connecting apex angles of two quadrangular pyramids to each other, which are included in the octahedron.

Figure 14B:
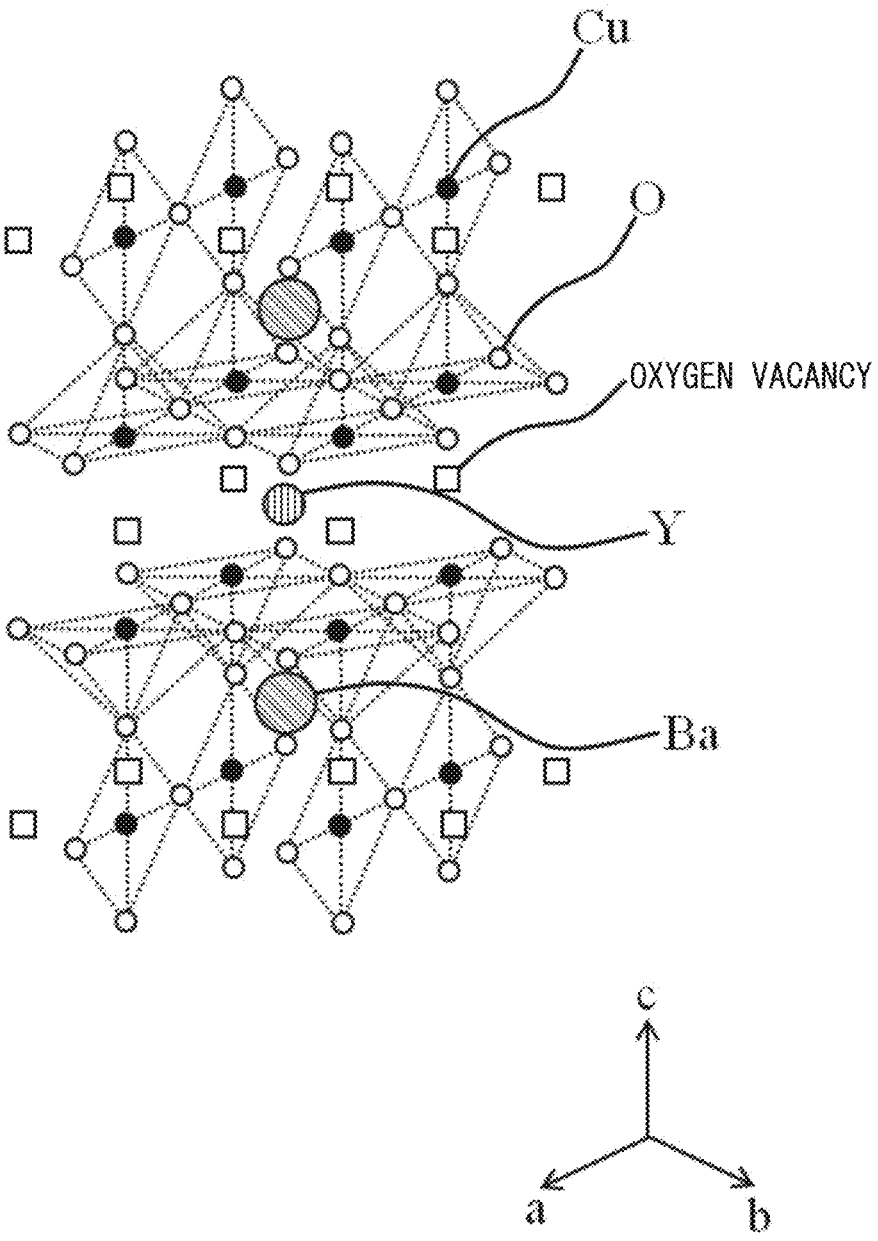
FIG. 14B is a view illustrating a-axis, b-axis, and c-axis in an example of a 123 phase.

As shown in FIG. 14B, a basic 123 phase has a crystalline structure in which Y and Ba are alternately disposed in an A-cation site of the perovskite structure, O in the same plane (a-b plane) as Y is substituted with an oxygen ion vacancy, and O of the octahedron, which is adjacent to the same plane (a-b plane) as Ba, is partially substituted with an oxygen ion vacancy. Therefore, the a-axis, b-axis, and c-axis of the 123 phase are in directions, for example, as shown in FIG. 14B.

In addition, the width of the ring-shaped oxide bulk (ring section) is a width along a disposition direction (a direction orthogonal to the rotation symmetry axis) of the nested structure, and for example, in an example shown in FIG. 1A, is a width W indicated by a double-headed arrow. In order to improve an effect of restricting a movement range of the magnetic flux during the pulse magnetization, the maximum dimension of the width of the ring section is preferably 20 mm or less, and more preferably 15 mm or less, and still more preferably 10 mm or less. On the other hand, when the width of the ring section is less than 1 mm, the occupancy ratio of the gaps in the entirety of the oxide superconducting bulk magnet member increases, such that the occupancy ratio of the oxide bulks decreases. Furthermore, when the occupancy ratio of the gaps with respect to the entirety of the oxide superconducting bulk magnet member increases, the magnetic field that can be obtained may be weakened or a yield after processing may be lowered. Therefore, the width of the ring section is preferably 1 mm or more. In regard to the preferable width of the ring section, a relationship between the number of layers of the above-described nested structure and the width of the ring section is as follows.

In regard to the width W of the ring section, in a case where the oxide bulks are equally divided by the gaps, the number N of layers is expressed with N=L/2W using the maximum size L of the oxide superconducting bulk magnet member (in an example of FIG. 1B, a size L of the oxide superconducting bulk magnet member). Therefore, a criterion of the upper limit in the preferable range of the above-described number of layers is 250 (N=500/(2×1)=250) when the maximum size L is 500 mm, and 50 (N=100/(2×1)=50) when the maximum size L is 100 mm. Therefore, the upper limit of the number of layers may be L/2.

In addition, the thickness H of the oxide superconducting bulk magnet member (for example, the thickness H in FIG. 1B) is not particularly limited, and may be determined according to a structure design for each use. From easiness of the pulse magnetization method, it is preferable that the thickness be ½ or more and 1/100 or less (that is, L/2 or more and L/100 or less) with respect to the maximum size L of the oxide superconducting bulk magnet member. From an aspect of maintaining mechanical strength that is easy to handle, the thickness H is preferably 1 mm or more. In addition, from an aspect of the processing time necessary to perform disposition of the nested structure, the thickness H is more preferably 30 mm or less.

In addition, in this embodiment, as described above, a gap 8 shown in FIG. 1A is formed between the oxide bulks disposed to form the nested structure. Particularly, the gap 8 is formed to have a predetermined width dimension. In the pulse magnetization method, the magnetic field rapidly varies during the magnetization, such that a rapid stress variation occurs in the oxide bulks disposed to form the nested structure, and thereby a minute strain occurs. When the pulse magnetization is repeated, there is a problem in that a part of the plurality of oxide bulks may be broken due to repetition of the stress variation and the strain. As a result, a strong and uniform magnetic field may not be obtained. Furthermore, when the gap becomes large, each of the oxide bulks is independently subjected to the stress variation and strain, such that each of the oxide bulks may be easily broken. That is, when the gap is made to be small, the stress variation and strain may be suppressed. Specifically, it is preferable that the width dimension of the gap between a pair of oxide bulks that are adjacent to each other be 0.49 mm or less. In addition, when at least a part of the gap (between the pair of bulk sections that are adjacent to each other) is provided with a resin, grease, or solder as a buffer material (interposed section) that suppresses the influence of the stress variation and strain, it is possible to significantly reduce the ratio of breakage due to an increase in the number of repetitions of the pulse magnetization until breakage occurs. Therefore, in this embodiment, the interposed section of the resin, grease, or solder is provided between the pair of bulk sections that are adjacent to each other.

In this manner, when the resin, grease, or solder is provided, the oxide bulks mechanically affect each other. Therefore, it is considered that it is possible to avoid each of the oxide bulks being independently subjected to the stress variation and strain, such that the breakage may be reduced. In order to further reduce the probability of breakage, the width dimension of the gap is more preferably 0.20 mm or less, and still more preferably 0.10 mm or less. In addition, when considering easy assembling and economical manufacturing by a light processing, the width dimension of the gap is 0.01 mm or more. That is, when the width dimension of the gap is less than 0.01 mm, it is difficult to insert each of the oxide bulks, and it is difficult to provide the resin, grease, and solder in the gap, such that this is not suitable for practical manufacturing.

In addition, the resin, grease, or solder, which is disposed in the gap, may be provided to at least a part of the gap. It is more preferable that the resin, grease, or solder occupy 10% or more and 100% or less of the total volume of the gap. Furthermore, it is still more preferable that the resin, grease, or solder occupy 50% or more of the total volume of the gap. In a case where the oxide superconducting bulk magnet member is manufactured and then each of the oxide bulks is semi-permanently fixed, it is preferable to use a hardening resin as the resin. In addition, in a case where the oxide bulks, which are disposed to form the nested structure, are made to be detachable, it is preferable to use grease or solder.

In addition, it is more preferable that a metallic ring (for example, a metallic ring 21 shown in FIG. 7) be fit around the outermost circumferential oxide bulk of the nested structure in order for the oxide bulks not to be cracked due to a hoop force (a force to increase a radius) that is generated by a magnetic field after magnetization. When configured in this way, compression stress acts on the oxide bulk from the metallic ring at the time of being cooled, because a coefficient of thermal expansion of the metallic ring is different from that of the oxide bulk, such that the probability that the oxide bulk is cracked due to the hoop force may be reduced. It is preferable that the resin, grease, or solder be filled between the metallic ring and the oxide bulk, and thereby the compression stress be equally applied to the oxide bulks disposed in the nested structure. As a material of the metallic ring, for example, a metallic material such as copper, aluminum, or stainless steel may be used. In a good conductor, a large shielding current flows during the pulse magnetization, such that it is more preferable to use an alloy-based material such as stainless steel having a high specific resistance. In addition, in a case where the oxide bulk is semi-permanently fixed to the metallic ring, it is preferable to use a hardening resin. In addition, in order to make the metallic ring detachable from the oxide bulk, the metallic ring may be fixed to the oxide bulk using the solder or grease. In the case of using the solder, the metallic ring may be detachable by heating the solder to a melting point thereof, and in the case of using the grease or the like, the metallic ring may be detachable at room temperature. Furthermore, it is preferable that a rotational symmetry axis of the metallic ring match the c-axis of the $REBa_2Cu_3O_{7-x}$ crystal.

The RE-Ba—Cu—O-based oxide bulk, which is used in this embodiment, has a structure in which a single crystal-like $RE_2BaCuO_5$ phase (211 phase) that is a non-superconducting phase is finely dispersed within a $REBa_2Cu_3O_{7-x}$ phase (123 phase) that is a superconducting phase. This single crystal-like phase is not a perfect single crystal, and includes a phase having a defect such as a small-angle boundary that is allowable for practical use. In addition, the phase of the single crystal-like (pseudo-single crystal) phase is a crystal phase in which the 211 phase as a second phase is finely dispersed (for example, substantially 1 μm) within the single crystal-like 123 phase. RE in the $REBa_2Cu_3O_{7-x}$ phase (123 phase) and the $RE_2BaCuO_5$ phase (211 phase) represents a rare-earth element, and is selected from rare-earth elements consisting of Y, La, Nd, Sm, Eu, Gd, Dy, Ho, Er, Tm, Yb, and Lu, and a combination thereof. In addition, the 123 phase including La, Nd, Sm, Eu, and Gd may be in a state in which a part of the RE site is substituted with Ba while being deviated from the stoichiometric composition (RE:Ba:Cu=1:2:3) of the 123 phase, but the 123 phase of this state is included in the 123 phase. In addition, in regard to the 211 phase that is the non-superconducting phase, the 211 phase in which La and Nd are included may be in a state slightly different from that of a 211 phase in which only Y, Sm, Eu, Gd, Dy, Ho, Er, Tm, Yb, and Lu are included. For example, in the 211 phase in which La and Nd are included, a ratio of metallic elements is a non-stoichiometric composition, or a crystalline structure is different from that of a 211 phase in which only RE is included other than La and Nd, but this case is also included in the 211 phase. In addition, x in the $REBa_2Cu_3O_{7-x}$ phase represents an amount of oxygen deficiency, and exceeds 0 and is 0.2 or less ($0<x\leq 0.2$). When the value of x is within this range, the $REBa_2Cu_3O_{7-x}$ phase shows superconductivity as a superconductor.

The above-described substitution of the RE site with the Ba element has a tendency to lower a critical temperature. In addition, when an oxygen partial pressure is lowered, the substitution of the RE site with the Ba element is suppressed. Therefore, it is preferable that the crystal growth be performed in 0.1 to 1% oxygen atmosphere in which oxygen is minutely mixed in argon or nitrogen, rather than in the air. In addition, when silver is contained in the RE-Ba—Cu—O-based oxide bulk, mechanical strength and $J_c$ characteristic may tend to increase, such that it is more preferable that 5 to 20 mass % of silver be contained. At this time, the 123 phase may be in a state in which a part of the Cu site is substituted with Ag while being deviated from the stoichiometric composition (RE:Ba:Cu=1:2:3), but a 123 phase of this state may also be included in the 123 phase.

As expressed by Equation (1), the 123 phase is generated by a peritectic reaction between the 211 phase and a liquid phase including a composite oxide of Ba and Cu.

211 phase+liquid phase (composite oxide of Ba and Cu)→123 phase (1)

A temperature (Tf: 123 phase generating temperature) at which the 123 phase is generated by the peritectic reaction is substantially related to an ion radius of the RE element, and as the ion radius decreases, Tf is lowered. In addition, accompanying the crystal growth in the low-oxygen atmosphere and the addition of silver in a liquid phase, Tf tends to decrease.

The oxide bulk in which the 211 phase is finely dispersed within the single crystal-like 123 phase is manufactured by crystal-growing the 123 phase in a manner such that a non-reacted 211 grain (211 phase) remains within the 123 phase. That is, the oxide bulk in this embodiment is generated by a reaction expressed by Equation (2).

211 phase+liquid phase (composite oxide of Ba and Cu)→123 phase+211 phase (2)

The fine dispersion of the 211 phase within the oxide bulk is very important from a $J_c$ improvement aspect. When at least one of Pt, Rh, and Ce is finely added in the liquid phase, a grain growth of the 211 phase in a semi-molten state (a state including the 211 phase and the liquid phase) is suppressed, and as a result, the 211 phase within a material is refined to substantially 1 μm or less. From an effect aspect with respect to the refinement and a material cost aspect, it is preferable that an addition amount of Pt be 0.2 to 2.0 mass %, an addition amount of Rh be 0.01 to 0.5 mass %, and an addition amount of Ce be 0.5 to 2.0 mass %. Pt, Rh, and Ce that are added to the liquid phase are partially dissolved within the 123 phase to form a solid solution. In addition, the remaining elements that may not be dissolved as a solute within the 123 phase form composite oxides together with Ba and Cu, and are scattered in the material.

In addition, it is necessary for the oxide bulk according to this embodiment to have a high critical current density ($J_c$) in the magnetic field. In order to satisfy this condition, a single crystal-like 123 phase, which does not include a large-angle boundary resulting in a weak coupling in superconductivity, is effective. In order to have further high $J_c$ characteristic, a pinning center to stop a movement of magnetic flux is effective. A phase functioning as this pinning center is the finely dispersed 211 phase, and it is preferable that the 211 phase be dispersed as finely and much as possible. In addition, the non-superconducting phase such as the 211 phase is finely dispersed within the 123 phase, which is susceptible to cleavage, and mechanically reinforces a superconductor, and therefore also has an important function of increasing the usability as a bulk material.

A ratio of the 211 phase within the 123 phase is preferably 5 to 35 volume % from $J_c$ characteristic and mechanical strength aspects. In addition, in general, 5 to 20 volume % of void (pore) having the size of substantially 50 to 500 μm is contained in the oxide bulk. Furthermore, in the case of adding silver, 25 volume % or less (exceeding 0 volume %) of silver or a silver compound of substantially 10 to 500 μm is contained in the oxide bulk in response to an additional amount of silver.

In addition, when being substantially 0.5, the amount of oxygen deficiency in the oxide bulk after the crystal growth shows a temperature dependency of a semiconductor-like resistivity. When the oxide bulk is annealed at 350° C. to 600° C. for substantially 100 hours in an oxygen atmosphere according to a kind of RE, oxygen is taken into the material, and therefore the amount of oxygen deficiency decreases to 0.2 or less and the oxide bulk shows a preferable superconducting characteristic.

Second Embodiment

In addition, when the gap 8 is relatively wide, when it is attempted to obtain a strong magnetic field by performing the magnetization through the pulse magnetization method, the magnetic field rapidly varies during the magnetization, such that each of the oxide bulks in the nested structure may gradually moves due to the repetitive pulse magnetization. In this case, a disposed position of each of the oxide bulks in the nested structure may be deviated and thereby the original strong and uniform magnetic field may not be maintained. Furthermore, in order to manufacture such oxide superconducting bulk magnet member, it is necessary to accurately process each of the oxide bulks and to assemble the oxide bulk to form the nested structure.

Figure 5:
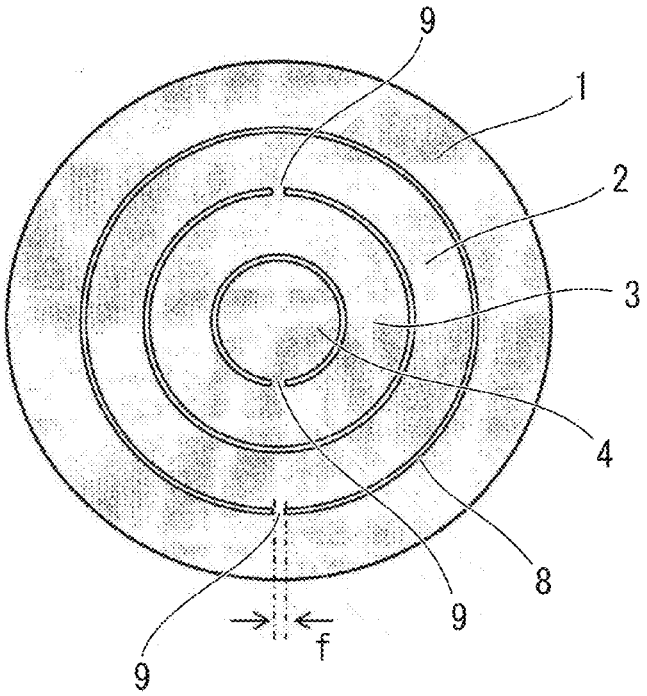
FIG. 5 is a top plan view illustrating a structure example in which a plurality of bulk sections including ring-shaped bulk sections are disposed to form the nested structure, and a part of these bulk sections are connected with a bridge portion.

Therefore, in an oxide superconducting bulk magnet member according to the second embodiment of the present invention, as shown in FIG. 5, at least one bridge portion (interposed section) 9 is further provided in addition to the oxide bulks (bulk sections) 1 to 4 in FIG. 1A. That is, in this embodiment, for example, the bridge portion 9 shown in FIG. 5 is provided instead of the buffer material 5, for example, the resin, grease, or solder shown in FIG. 1A. The oxide bulks 1 to 4 are connected continuously by the bridge portion 9. Therefore, even when the gap 8 is formed between the oxide bulks, the bridge portion 9 may restrict the movement of the magnetic flux during the pulse magnetization, and thereby a strong and uniform magnetic field may be obtained. In addition, even when the oxide superconducting bulk magnet member with this configuration is applied as a magnet of a rotary machine such as a superconducting generator and a superconducting motor, and receives centrifugal force or vibration, the position of each of the oxide bulks in the nested structure is not deviated. In addition, even when the pulse magnetization is repeated, the position of each of the oxide bulks in the nested structure is not deviated. In addition, in this embodiment, a description of portions redundant to those of the first embodiment will be omitted or simplified.

In addition, FIG. 5 shows an example in which all of the gaps from the outer circumferential ring section to the core section are connected by the bridge portions 9, but a part of the bridge portions 9 may be omitted. For example, when seen from an outer circumferential direction of FIG. 5, gaps from a first ring section (corresponding to a ring section 1 in FIG. 5) to a third ring section (corresponding to a ring section 3 in FIG. 5) may be connected by the bridge portion, and the core section (corresponding to a core section 4 in FIG. 5) may be present independently. In addition, the first ring section and the second ring section (corresponding to a ring section 2 in FIG. 5) may be connected by the bridge portion, and the third ring section and the core section may be connected by the bridge portion. Furthermore, in a case where structural elements that are independent from each other (that is, oxide bulks that are independent from each other) are included, RE-Ba—Cu—O-based oxide bulks in which a chemical element corresponding to RE is the same in each case may be combined between the structural elements, or a plural kinds of RE-Ba—Cu—O-based oxide bulks in which the chemical element corresponding to RE is different in each case may be combined. In the latter case, in regard to the chemical element corresponding to RE, the RE-Ba—Cu—O-based oxide bulks of at least one of the structural elements is different from those of other structural elements. For example, the RE-Ba—Cu—O-based oxide bulks in which the chemical element corresponding to RE is different in each case may be prepared by combining a chemical elements selected from a group consisting of Sm, Eu, Gd, Dy, Y, and Ho as RE. In this case, entire characteristics of the oxide superconducting bulk magnet member may be improved by changing the composition of RE while considering the $J_c$ characteristic of the RE-Ba—Cu—O-based oxide bulk.

The above-described gap 8 and bridge portion 9 may be formed by a process of removing a portion serving as the gap through a processing such as a sand blast processing, an electrical discharge machining, an etching processing, a laser processing, a water jet processing, and an ultrasonic processing, such that the oxide superconducting bulk magnet member may be easily manufactured without a process of inserting each of the oxide bulks to form the nested structure.

In addition, when the width dimension f of the bridge portion 9 is 0.1 mm or more, the oxide bulks may be fixed to each other, and therefore mechanical strength that is capable of withstanding handling may be sufficiently obtained. Therefore, it is preferable that the width dimension f of the bridge portion 9 be 0.1 mm or more. In addition, it is preferable that the width dimension f of the bridge portion 9 be 25% or less with respect to a circumferential distance of a gap of one ring section (an outer circumferential dimension of the ring section). In a case where a plurality of bridge portions 9 is present in the gap of one ring section, it is more preferable that the sum of the width dimension f of bridge portions be 25% or less. When the sum of the width dimension f is 25% or less, it is difficult for current to flow through the bridge portions during the pulse magnetization, such that a uniform magnetic field may be easily obtained. In addition, the width dimension f of the bridge portion is a dimension along the outer circumference of an inner side (inner circumference side) bulk section between a pair of bulk sections that are adjacent to each other.

In addition, in FIG. 5, an example in which one bridge portion is provided in a gap of one ring section. However, the number of the bridge portions may be a plural number of two or more. It is preferable that the number of bridge portions be increased, as a circumferential distance of the gap between the ring sections becomes large. From a processing efficiency aspect, when the circumferential distance of the gap of the ring section is 300 mm or less, it is more preferable that the number of the bridge portions be 20 or less, and when the circumferential distance of the gap of the ring section is 900 mm or less, it is more preferable that the number of bridge portions be 40 or less. In addition, the number of layers in the nested structure is two or more to form the nested structure. In the example shown in FIG. 5, the oxide bulks 1 to 4 are disposed to form the nested structure, and therefore the number of layers thereof is four. Here, as the oxide superconducting bulk magnet member becomes large, it is preferable that the number of layers increase. Normally, in order to obtain a relatively strong and uniform magnetic field by performing the pulse magnetization, it is preferable that the number of layers be 4 or more, and more preferably 5 or more.

Furthermore, in this embodiment, a processing time is necessary to process the gap and the bridge portion shown in FIG. 5, such that it is preferable that a thickness dimension of the oxide bulk in the direction of the rotational symmetry axis (a thickness dimension of a layer in the case of stacking or lamination) be 5 mm or less. Particularly, in the case of performing the gap processing of the nested structure by sand blasting, it is more preferable that the thickness dimension be 3.0 mm or less. Furthermore, from a mechanical strength aspect, it is preferable that the thickness dimension be 1.0 mm or more. In addition, from an aspect of manufacturing efficiency such as a processability, it is preferable that the gap (for example, the gap 8 shown in FIG. 5) formed between the oxide bulks that are adjacent to each other be 0.01 mm or more and 2.00 mm or less. In addition, from a magnetic field generation aspect, it is preferable that the gap be 0.45 mm or less.

In this embodiment, as described above, the oxide superconducting bulk magnet member is provided with the bridge portion (interposed section) that connects a pair of oxide bulks (bulk sections) that are adjacent to each other. Similarly to the oxide superconducting bulk magnet member of the first embodiment, the circumferential shape of the oxide bulk, the width W of a ring section, the thickness H of the oxide superconducting bulk magnet member, the number of layers, the number of stacked layer (number of layers) in the direction of the rotational symmetry axis, the inner diameter of a hollow section in a case where the hollow section is present, the direction of the crystal axis between independent elements (a-axis, b-axis, and c-axis), the material of the metallic ring, and the material of the RE-Ba—Cu—O-based oxide bulk may be applied to the oxide superconducting bulk magnet member of this embodiment. In addition, in order to prevent the cracking due to the hoop force, it is preferable that at least a part of the gap is further provided with resin, grease, or solder by filling or the like regardless of whether or not the bridge portion is present. Furthermore, in the case of including elements that are independent from each other, the first embodiment may be applied between the elements.

As described above, the oxide superconducting bulk magnet member of the present invention shows a magnet characteristic that is excellent in the magnetization property capable of generating a desired magnetic field distribution. Therefore, an oxide superconducting magnet system using the oxide superconducting bulk magnet member may easily generate a high magnetic field over the entirety of the system with a low energy input, such that the oxide superconducting magnet system is excellent in economical efficiency and environmental compatibility.

EXAMPLES

Example 1

Reagents $RE_2O_3$ (RE represents Gd and Dy), $BaO_2$, and Cu, which have purity of 99.9% or more, were mixed in a manner such that the mole ratio of the respective metallic elements of Gd:Dy:Ba:Cu is 9:1:14:20 (that is, a mole ratio of a 123 phase:a 211 phase of an final structure is 3:1), and thereby a mixed powder was prepared. Furthermore, 0.5 mass % of Pt and 15 mass % of $Ag_2O$ were added to the mixed powder and thereby a mixed powder was prepared. Each of the mixed powders was calcinated at 880° C. for 8 hours. Each of the calcinated powders was filled in a cylindrical metallic mold having an inner diameter of 82 mm, and was molded to have a disk shape having the thickness of substantially 33 mm. In addition, an Sm-based disk-shaped compact (molded powder) and a Yb-based disk-shaped compact, which have a thickness of 4 mm, were prepared using $Sm_2O_3$ and $Yb_2O_3$ as $RE_2O_3$ by the same method as the compacts. Furthermore, each of the compacts was formed by isostatic pressing (compression) at substantially 100 MPa.

These compacts were disposed inside a furnace in a manner such that each of the compacts is disposed on an alumina support and stacked in the order of the Sm-based compact, the Yb-based compact, and the Gd—Dy-based compact (precursors) from a lower side. A temperature of the precursors was raised to 700° C. within 15 hours in the air, to 1040° C. within 160 hours, and to 1170° C. within 1 hour, and then the precursors were maintained at this temperature for 30 minutes, and the temperature was lowered to 1030° C. within 1 hour and then the precursors were maintained at this temperature for 1 hour. Meanwhile, an Sm-based seed crystal that was prepared in advance was used and the seed crystal was carried onto a semi-molten state precursor. A cleavage plane of the seed crystal was carried onto the precursor in a manner such that a c-axis of the seed crystal matches a normal line of the disk-shaped precursor. Then, the precursors were cooled to a temperature of 1000° C. to 985° C. within 280 hours in the air to promote a crystal growth. Furthermore, the precursors were cooled to room temperature within 35 hours, and thereby a Gd—Dy-based oxide superconductor having an outer diameter of substantially 63 mm, and a thickness of substantially 28 mm was obtained. In addition, two of the same Gd—Dy-based oxide superconductors were further prepared by the same method, and a total of three samples (for Sample A, Sample B, and Sample C that are described later) was obtained. These samples had a microstructure in which the $RE_2BaCuO_5$ phase of substantially 1 μm and the silver of 50 to 500 μm are dispersed within the $REBa_2Cu_3O_{7-x}$ phase. These three samples were processed, and each of two samples was disposed to form the nested structure. Here, Sample A in which the gap of the nested structure is 0.1 mm, and Sample B in which the gap of the nested structure is 0.5 mm, and monolithic Sample C in which the gap of the nested structure is not present as a comparative example were prepared.

Figure 6:
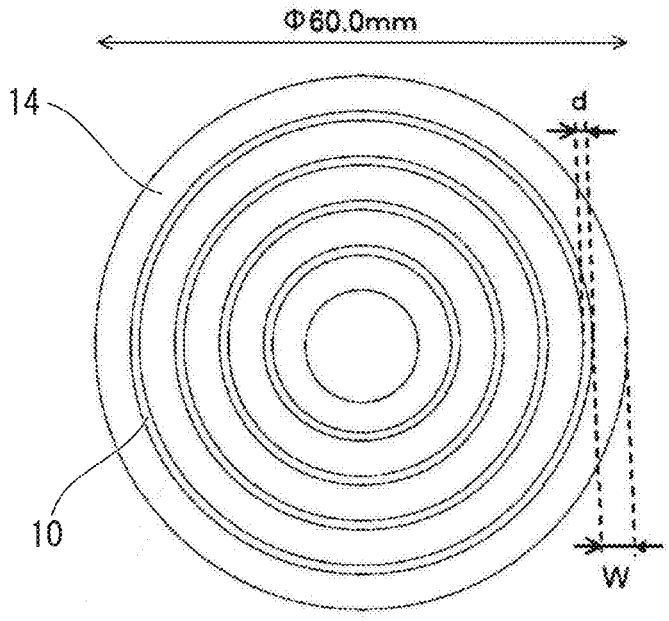
FIG. 6 is a top plan view illustrating a five-fold ring shape that is manufactured by Example 1.

Sample A had a shape shown in FIG. 6, and the width dimension W of each of oxide bulks (superconductors) of a five-fold ring 14 having an outer diameter of 60 mm was 4.9 mm, and the width dimension d of the gap between the oxide bulks was 0.1 mm. The height of each ring (each ring section) was 20.0 mm. In addition, Sample B had the same shape as the five-fold ring 14 having the outer diameter of 60 mm shown in FIG. 6. In Sample B, the width dimension W of each of oxide bulks (superconductors) was 4.5 mm, and the width dimension d of the gap between the oxide bulks was 0.5 mm. Both five ring-shaped oxide bulks (superconductors) of Sample A and Sample B were disposed to form a nested structure, after an oxygen annealing process, and were housed in a stainless ring having an outer diameter of 64.0 mm and an inner diameter of 60.1 mm, and were fixed by an epoxy resin.

In addition, Sample C was processed to have a disk shape having an outer diameter of 60.0 mm, and a height of 20.0 mm, and then was subjected to the oxygen annealing process as described above, and then disposed inside a stainless ring having an outer diameter of 64.0 mm and an inner diameter of 60.1 mm, and was fixed by an epoxy resin. With respect to Sample A to Sample C, first, a trapped magnetic field under the static magnetic field magnetization was compared. In regard to the a magnetic cooling, Sample A to Sample C were disposed within a magnetic field of 3.5 T at room temperature, and were cooled to 77 K by liquid nitrogen, and then the external magnetic field was lowered to zero with a demagnetizing rate of 0.5 T/minute.

Figure 8A:
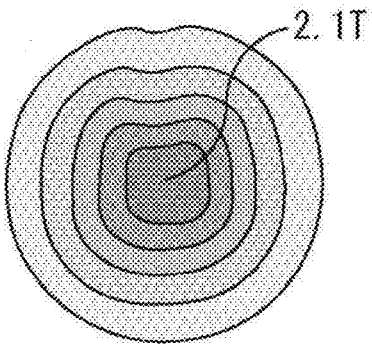
FIG. 8A is a view illustrating a trapped magnetic flux distribution when sample C manufactured by Example 1 is magnetized by a static magnetic field magnetization.
Figure 8B:
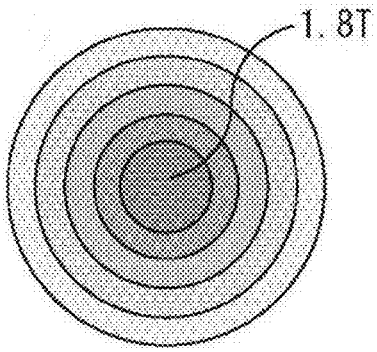
FIG. 8B is a view illustrating a trapped magnetic flux distribution when sample A manufactured by Example 1 is magnetized by the static magnetic field magnetization.

In an oxide superconducting bulk magnet using Sample A of this example, it was confirmed that as shown in FIG. 8B, a uniform magnetic field distribution with a shape of concentric circles, which has a peak magnetic field of 1.8 T, was obtained, and a magnetic field distribution having a significantly improved symmetry property was obtained. On the other hand, an oxide superconducting bulk magnet using Sample C as a comparative example was a monolithic magnet in which the gap due to the nested structure is not formed, such that as shown in FIG. 8A, the peak magnetic field was enlarged by the absence of the gap. However, the symmetric and uniform magnetic field was not obtained due to distortion of four-fold symmetry close to a square shape. In a case where Sample B was set as the oxide superconducting bulk magnet, similarly to the magnetic field distribution shown in FIG. 8B, a uniform distribution with a shape of concentric circles was obtained. However, the gap due to the nested structure was large, and was 0.5 mm, such that the peak magnetic field was 1.5 T.

Next, the pulse magnetization was performed with respect to these samples. With respect to samples dipped into liquid nitrogen within a zero magnetic field, a pulse magnetic field of an applied magnetic field of 5 T was applied with a pulse width of 5 ms and then a pulse magnetic field of 4 T was applied. In addition, the c-axis direction of the samples was a normal line direction of a disk surface, and the magnetic field was applied in parallel to the c-axis.

Figure 8C:
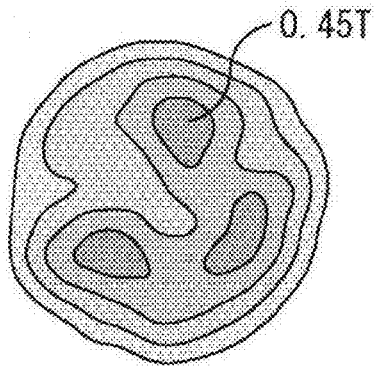
FIG. 8C is a view illustrating a trapped magnetic flux distribution when sample C manufactured by Example 1 is magnetized by a pulse magnetization.
Figure 8D:
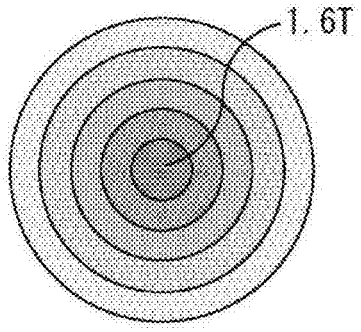
FIG. 8D is a view illustrating a trapped magnetic flux distribution when sample A manufactured by Example 1 is magnetized by the pulse magnetization.

In FIG. 8C, a pulse magnetization result of Sample C after applying a pulse of 4 T is shown. A non-uniform magnetic field distribution with a low symmetry property and peak magnetic field of 0.45 T and a valley was formed in the a-axis direction was obtained. Contrary to this, in Sample A of this example, it was confirmed that as shown in FIG. 8D, a uniform magnetic field distribution with a shape of concentric circles, which has a peak magnetic field of 1.6 T, was obtained, and a magnetic field distribution having a significantly good symmetry property was obtained even when the pulse magnetization is applied. In addition, the same pulse magnetization was repeated over 100 times, and then the magnetic flux distribution was measured, and then the peak magnetic field was compared. From this comparison, it was confirmed that the peak magnetic field of Sample A was 97% with respect to a value before the repetition and was rarely lowered. Next, the same pulse magnetization was performed with respect to Sample B. The peak magnetic field of 1.3 T was obtained, and the strength of the magnetic field was lowered compared to Sample A since the gap increases. Furthermore, although not shown, in the pulse magnetization, the magnetic field distribution had a distorted shape compared to FIG. 8D. This is considered because the magnetic field rapidly varies in the pulse magnetization due to a large gap, and each ring is deviated from a concentric disposed position. In addition, the same pulse magnetization was repeated over 100 times, and then the magnetic flux distribution was measured, and then the peak magnetic field was compared. From this comparison, it was confirmed that the peak magnetic field of Sample B was 72% with respect to a value before the repetition, and thereby characteristics were deteriorated. This is considered because the gap of Sample B is larger than that of Sample A, such that the characteristics were deteriorated by stress deformation due to the repetitive pulse.

From the above-described results, when the oxide superconducting bulks are disposed to form the nested structure and a gap with a specific width is provided between the oxide bulks, in the case of performing the static magnetic field magnetization, the oxide superconducting bulk magnet member generates a magnetic field that is excellent in a symmetry property and a uniformity, which has a shape of concentric circles, as a superconducting bulk magnet. Furthermore, even in the case of performing the pulse magnetization, the oxide superconducting bulk magnet member generates a magnetic field that is very excellent in the magnetization characteristic and is symmetric and uniform.

Example 2

Next, with respect to Sample 2-1 to Sample 2-7 in which only the width dimension d of the gap was changed and which were prepared by the same manufacturing method as Example 1, the same experiment as Example 1 was performed and the results thereof are shown in Table 1 described below. As an example in which the width dimension d of the gap is small, the width dimension d of the gap was set to 0.05 mm (Sample 2-1), 0.1 mm (Sample A), 0.15 mm (Sample 2-2), 0.20 mm (Sample 2-3), 0.30 mm (Sample 2-4), and 0.45 mm (Sample 2-5). In addition, as an example in which the width dimension d of the gap is large, the width dimension d of the gap was set to 0.5 mm (Sample B), 1.0 mm (Sample 2-6), and 1.2 mm (Sample 2-7). In addition, in Table 1, Sample A and Sample B in Example 1 are indicated by sample numbers 1-1 (Sample A) and 1-2 (Sample B).

TABLE 1

| Sample No. | Gap (mm) | Width in Direction Orthogonal to Axis (mm) | Peak value in Static Magnetic Field Magnetization (T)/ Uniformity and Symmetry Property in Magnetic Field Distribution | Peak value in Pulse Magnetization (T)/ Uniformity and Symmetry Property in Magnetic Field Distribution | Percentage of Peak Magnetic Field after Pulse Magnetization over 100 Times to Peak Magnetization in First Pulse Magnetization (%) |
|---|---|---|---|---|---|
| 2-1 | 0.05 | 4.95 | 1.8/Excellent | 1.6/Excellent | 98 |
| 1-1 | 0.1 | 4.9 | 1.8/Excellent | 1.6/Excellent | 97 |
| 2-2 | 0.15 | 4.85 | 1.8/Excellent | 1.6/Excellent | 95 |
| 2-3 | 0.2 | 4.8 | 1.8/Excellent | 1.6/Excellent | 95 |
| 2-4 | 0.3 | 4.7 | 1.8/Excellent | 1.6/Excellent | 94 |
| 2-5 | 0.45 | 4.55 | 1.8/Excellent | 1.6/Good | 91 |
| 1-2 | 0.5 | 4.5 | 1.7/Excellent | 1.3/Acceptable | 72 |
| 2-6 | 1.0 | 4.0 | 1.6/Excellent | 1.1/Acceptable | 61 |
| 2-7 | 1.2 | 3.8 | 1.5/Excellent | 1.0/Unacceptable | 55 |

As shown in Table 1, in Sample 2-1 to Sample 2-5, preferable results were obtained. As is clear from these results, when the width dimension d of the gap exceeds 0.49 mm, in the case of performing the repetitive pulse magnetization, the rings of the oxide superconducting bulks are easily cracked due to stress accompanied with a rapid variation of the magnetic field, and it is difficult to be stably used as the bulk magnet. In addition, rings having the width dimension d of the gap of 0.008 mm were processed and prepared, but it was difficult to assemble the rings and it was difficult to insert a resin in the gap.

Example 3

Next, relatively thin superconductors were stacked as shown in FIG. 3A, and manufacturing conditions and test results of an oxide superconducting bulk magnet member having a shape of concentric circles, which was manufactured by substantially the same manufacturing method as Example 1, were shown in Table 2 described below. In addition, portions between layers of the superconductor in the axial direction (in the direction of the rotational symmetry axis) were fixed with the same material as that used in the diameter direction, that is, between the rings. In addition, with respect to Sample 1-2 having a stacked structure of Sample B, and Sample 3-2, Sample 3-4, Sample 3-6, Sample 3-7, and Sample 3-9 which have the width dimension d of the gap more than 0.49 mm, the same test was performed. In addition, in Sample 3-3, Sample 3-4, Sample 3-5, Sample 3-6, Sample 3-8, Sample 3-9, Sample 3-11, and Sample 3-12, a circular plate-shaped material instead of a ring-shaped material was used as the innermost superconductor.

TABLE 2

| Sample No. | Gap (mm) | Outermost Diameter/ Minimum Inner Diameter (mm) | Number of Layers | Width in Direction Orthogonal to Axis (mm) | Thickness in Direction of Axis (mm) | Number of Layers in Direction of Axis | Resin, Grease, Solder, or None | Thickness of SUS Ring for Support (mm) | Deviation of c-axis (±°) |
|---|---|---|---|---|---|---|---|---|---|
| 1-1 | 0.1 | 60/10.2 | 5 | 4.9 | 1.5 | 13 | Resin | 2 | 8 or less |
| 1-2 | 0.5 | 60/11.0 | 5 | 4.5 | 1.5 | 13 | Resin | 2 | 8 or less |
| 3-1 | 0.2 | 60/10.4 | 5 | 4.8 | 2.0 | 10 | Grease | 3 | 10 or less |
| 3-2 | 0.6 | 60/11.2 | 5 | 4.4 | 2.0 | 10 | Grease | 3 | 10 or less |
| 3-3 | 0.3 | 60/0 | 6 | 4.7 | 1.8 | 11 | Resin | 1.5 | 10 or less |
| 3-4 | 0.8 | 60/0 | 6 | 4.2 | 1.8 | 11 | Resin | 1.5 | 10 or less |

TABLE 2-continued

| | | | | | | | | | |
|---|---|---|---|---|---|---|---|---|---|
| 3-5 | 0.1 | 60/0 | 6 | 4.9 | 1.5 | 13 | Resin | 2 | 8 or less |
| 3-6 | 0.5 | 60/0 | 6 | 4.5 | 1.5 | 13 | Resin | 2 | 25 or less |
| 3-7 | 0.8 | 60/11.6 | 5 | 4.2 | 2.5 | 8 | Grease | 1 | 35 or less |
| 3-8 | 0.4 | 100/0 | 5 | 9.4 | 1.5 | 13 | Resin | 3 | 8 or less |
| 3-9 | 0.8 | 100/0 | 5 | 9.2 | 1.5 | 13 | None | 3 | 8 or less |
| 3-10 | 0.2 | 60/10.4 | 5 | 4.8 | 2.0 | 10 | Solder | 3 | 10 or less |
| 3-11 | 0.4 | 100/0 | 5 | 9.4 | 1.5 | 13 | Solder | 3 | 8 or less |
| 3-12 | 0.1 | 60/0 | 6 | 4.9 | 1.5 | 13 | Solder | 2 | 8 or less |

| Sample No. | Displacement of a-axis (°) | Peak value in Static Magnetic Field Magnetization (T)/ Uniformity and Symmetry Property in Magnetic Field Distribution | Peak value in Pulse Magnetization (T)/ Uniformity and Symmetry Property in Magnetic Field Distribution | Percentage of Peak Magnetic Field after Pulse Magnetization over 100 Times to Peak Magnetization in First Pulse Magnetization (%) |
|---|---|---|---|---|
| 1-1 | 10 | 1.8/Excellent | 1.6/Excellent | 97 |
| 1-2 | 10 | 1.7/Excellent | 1.3/Acceptable | 72 |
| 3-1 | 5 | 1.8/Excellent | 1.6/Excellent | 96 |
| 3-2 | 5 | 1.7/Excellent | 1.3/Acceptable | 71 |
| 3-3 | 5 | 1.9/Excellent | 1.6/Excellent | 96 |
| 3-4 | 5 | 1.8/Excellent | 1.3/Acceptable | 71 |
| 3-5 | 10 | 1.8/Excellent | 1.6/Excellent | 97 |
| 3-6 | 10 | 1.6/Good | 1.1/Acceptable | 70 |
| 3-7 | 0 | 1.2/Acceptable | 0.5/Unacceptable | 66 |
| 3-8 | 10 | 2.5/Excellent | 2.2/Excellent | 95 |
| 3-9 | 10 | 2.5/Excellent | 1.8/Acceptable | 72 |
| 3-10 | 5 | 1.8/Excellent | 1.6/Excellent | 97 |
| 3-11 | 10 | 2.5/Excellent | 2.2/Excellent | 95 |
| 3-12 | 10 | 1.8/Excellent | 1.6/Excellent | 96 |

As shown in Table 2, in Sample 1-1, Sample 3-1, Sample 3-3, Sample 3-5, Sample 3-8, Sample 3-10, Sample 3-11, and Sample 3-12, which have the stacked structure of Sample A, a preferable result was obtained. As can be understood from this result, when the width dimension d of the gap exceeds 0.49 mm, in the case of repeating the pulse magnetization, the rings of the superconductors (oxide bulks) tends to be rapidly cracked due to the stress of the pulse magnetic field. That is, it can be understood that when the width dimension d of the gap is 0.49 mm or less, even when the pulse magnetization is repeated, a symmetric uniform magnetic field may be stably obtained. This is considered because the size of the gap between the superconductors has a great effect on the compression stress effect of the stainless ring with respect to a difference in the coefficient of thermal expansion between the superconductor and an epoxy resin, grease, or solder disposed in the gap between the superconductors, and the hoop force due to the magnetization.

Example 4

Reagents $Gd_2O_3$, $BaO_2$, and CuO, which have purity of 99.9% or more, were mixed in a manner such that a mole ratio of the respective metallic elements of Gd:Ba:Cu is 5:7:10 (that is, a mole ratio of a 123 phase:a 211 phase of a final structure is 3:1), and thereby a mixed powder was prepared. Furthermore, 1.5 mass % of $BaCeO_3$ and 12 mass % of $Ag_2O$ were added to the mixed powder and thereby a mixed powder was prepared. The mixed powder was calcinated at 880° C. for 8 hours. The calcinated powder was filled in a cylindrical metallic mold having an inner diameter of 82 mm, and was molded to have a disk shape having the thickness of substantially 33 mm. In addition, an Sm-based disk-shaped compact and a Yb-based disk-shaped compact, which have a thickness of 4 mm, were prepared using $Sm_2O_3$ and $Yb_2O_3$ as $RE_2O_3$ by the same method as the above-described compacts. Furthermore, each of the compacts was formed by isostatic pressing (compressing) at substantially 100 MPa.

These compacts were disposed inside a furnace in a manner such that each of the compacts is disposed on an aluminum support and stacked in the order of the Sm-based compact, the Yb-based compact, and the Gd-based compact (precursors) from a lower side. A temperature of the precursors was raised to 700° C. within 15 hours in the air, to 1040° C. within 40 hours, and to 1170° C. within 1 hour, and then the precursors were maintained at this temperature for 30 minutes, and the temperature was lowered to 1030° C. within 1 hour and then the precursors were maintained at this temperature for 1 hour. Meanwhile, an Sm-based seed crystal that was prepared in advance was used and the seed crystal was carried onto a semi-molten state precursor. A cleavage plane of the seed crystal was carried onto the precursor in a manner such that a c-axis of the seed crystal matches a normal line of the disk-shaped precursor. Then, the precursors were cooled to a temperature of 1000° C. to 985° C. within 280 hours in the air to promote crystal growth. Furthermore, the precursors were cooled to room temperature within substantially 35 hours, and thereby a Gd-based oxide superconductor having an outer diameter of substantially 63 mm, and a thickness of substantially 28 mm were obtained. In addition, two of the same Gd-based oxide superconductors were further prepared by the same method, and total three samples (for Sample D, Sample E, and Sample F that are described later) were obtained. The Sample D to Sample F had a structure in which the $Gd_2BaCuO_5$ phase of substantially 1 μm and the silver of 50 to 500 μm are dispersed within the $GdBa_2Cu_3O_{7-x}$ phase.

Figure 7:
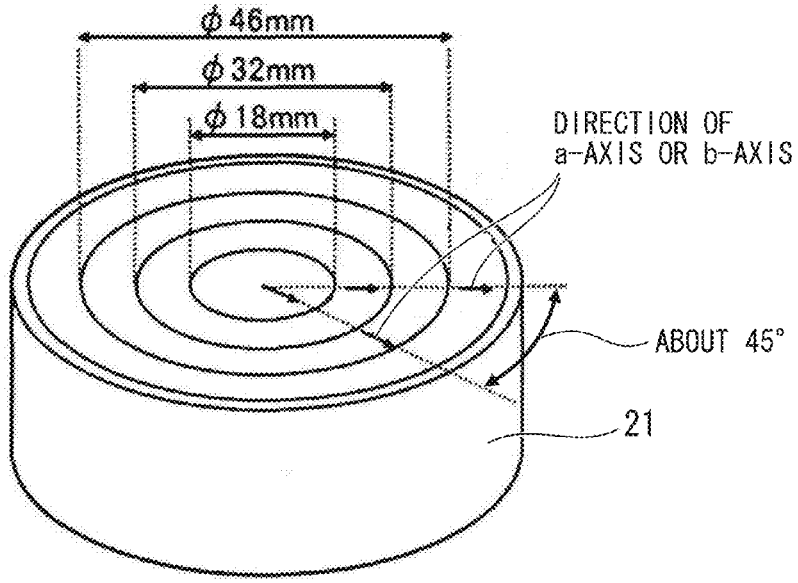
FIG. 7 is a view illustrating a shape of an oxide superconducting bulk magnet member having the nested structure, which is manufactured by Example 4.

Next, a ring having an outer diameter of 59.9 mm, an inner diameter of 46.0 mm and a height of 20.0 mm, and a ring having an outer diameter of 31.9 mm, an inner diameter of 18.0 mm and a height of 20.0 mm were cut from Sample D. In addition, a ring having an outer diameter of 45.9 mm, an inner diameter of 32.0 mm and a height of 20.0 mm, and a column having an outer diameter of 17.9 mm and a height of 20.0 mm were cut from Sample E. Each of the rings and column was subjected to an oxygen annealing process, and then was disposed to form a nested structure in a stainless ring having an outer diameter of 64.0 mm and an inner diameter of 60.1 mm as shown in FIG. 7, and then the stainless ring and the rings were fixed with an epoxy resin. At this time, the oxide superconductors were disposed in a manner such that the a-axis or b-axis direction of the oxide superconductors cut from Sample D, and the oxide superconductors cut from Sample E is alternately deviated by 45° in each case, and thereby an oxide superconducting bulk magnet member (Sample 4-1) was manufactured.

In addition, Sample F was processed to have a disk shape having an outer diameter of 60.0 mm and a height of 20.0 mm instead of the ring as a comparative example, and then was subjected to the same oxygen annealing process, and then Sample F that was processed was disposed inside a stainless ring having an outer diameter of 64.0 mm and an inner diameter of 60.1 mm, and the gap between the stainless ring and Sample F was fixed with the epoxy resin (Sample 4-2).

With respect to these samples, the magnetization was performed by the magnetization method by a magnetic cooling (static magnetic field magnetization method) and the pulse magnetization method. In regard to the magnetic cooling, the samples were disposed within a magnetic field of 3.5 T at room temperature, and then were dipped into liquid nitrogen within a zero magnetic field to cool them, and then external magnetic field was lowered to zero with a demagnetizing rate of 0.5 T/minute. In addition, in regard to the pulse magnetization, a pulse magnetic field in which a pulse width is substantially 5 ms and a maximum applied magnetic field was 5.0 T was applied with respect to the samples dipped into the liquid nitrogen. In addition, the c-axis direction of the samples was a normal line direction of a disk surface, and the magnetic field was applied parallel to the c-axis.

Sample 4-2 of the comparative example is set as a superconducting bulk magnet according to the magnetization method due to the magnetic field cooling, a magnetic field distribution accompanying four-fold symmetry distortion that is similar to a distribution shown in FIG. 8A was obtained and a peak magnetic field was 2.1 T. Contrary to this, when Sample 4-1 of this example was set as a superconducting bulk magnet, a magnetic field distribution in which the four-fold symmetry distortion was relatively less was obtained and the peak magnetic field was 2.0 T. In this manner, even in the static magnetic field magnetization method, in an oxide superconducting bulk magnet member in which the gap of the nested structure was formed, a relatively symmetric and uniform magnetic field distribution was obtained compared to an oxide superconducting bulk magnet member not having the nested structure.

Figure 9A:
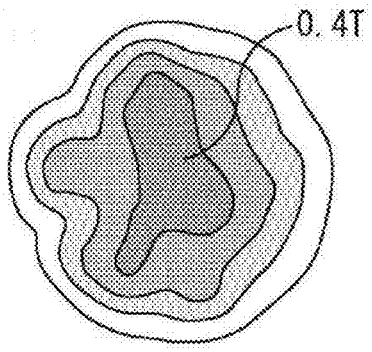
FIG. 9A is a view illustrating a trapped magnetic flux distribution when sample 4-2 manufactured by Example 4 is magnetized by the pulse magnetization.
Figure 9B:
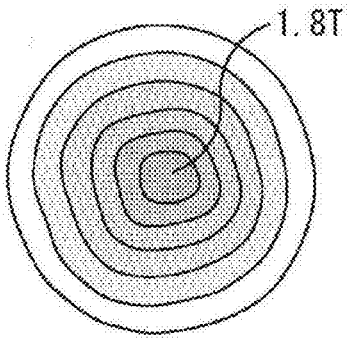
FIG. 9B is a view illustrating a trapped magnetic flux distribution when sample 4-1 manufactured by Example 4 is magnetized by the pulse magnetization.

Results of the pulse magnetization method are shown in FIGS. 9A and 9B. When Sample 4-2 of the comparative example was set as the oxide superconducting bulk magnet, as shown in FIG. 9A, the magnetic field distribution considerably varied from the shape of concentric circles, and the peak magnetic field was 0.40 T and remained at a low value. Contrary to this, when Sample 4-1 of this example was set as a superconducting bulk magnet, as shown in FIG. 9B, the four-fold symmetry distortion slightly remained, but a magnetic flux density distribution having the shape of substantially concentric circles was obtained, and a peak magnetic flux density was 1.8 T. From this comparison, it was found that when the oxide superconducting bulk magnet member in which rings are disposed to form the nested structure and the gap is provided is set as the oxide superconducting bulk magnet after being magnetized by the pulse magnetization method, the magnetization characteristic is significantly superior.

Example 5

Three Gd-based bulk superconductors having an outer diameter of substantially 63 mm and a thickness of substantially 28 mm (Sample G, Sample H, and Sample I) were prepared by the same manufacturing method as the manufacturing method illustrated in Example 4.

Next, a hexagonal ring-shaped oxide bulk (hexagonal ring) having a length of one side of an outer circumference of substantially 30 mm, a length of one side of an inner circumference of substantially 20 mm, and a height of 20 mm, and a hexagonal column having a length of one side of substantially 10 mm and a height of 20 mm were cut from Sample G. In addition, a hexagonal ring-shaped oxide bulk having a length of one side of an outer circumference of substantially 20 mm, a length of one side of an inner circumference of substantially 10 mm, and a height of 20 mm was cut from Sample H. Here, the hexagonal rings of Sample G and Sample H were cut in a manner such that when Sample G and Sample H are combined, the crystal axis direction (a-axis or b-axis direction) is deviated by 45° in each case. The oxide bulks, which were cut, were subjected to an oxygen annealing process and then were disposed to form a nested structure in a stainless ring having an outer diameter of 64.0 mm and an inner diameter of 60.1 mm. At this time, the gap between the superconductors was adjusted to 0.1 mm or less. Furthermore, the gap was fixed with an epoxy resin. At this time, the oxide superconductors were disposed in a manner such that the a-axis or b-axis direction of the oxide superconductors cut from Sample G, and the oxide superconductor cut from Sample H is alternately deviated by 45° in each case, and thereby an oxide superconducting bulk magnet member (Sample 5-1) was manufactured.

In addition, Sample I as a comparative example was processed into a hexagonal column having a length of one side of substantially 30 mm, and a height of 20 mm so as to be a monolithic-type not having the nested structure, and then was subjected to the same oxygen annealing process, and then was disposed inside a stainless ring having an outer diameter of 64.0 mm and an inner diameter of 60.1 mm, and then the gap between the stainless ring and the oxide superconductor was fixed with an epoxy resin (Sample 5-2).

With respect to these samples, the magnetization was performed by the magnetization method by a magnetic cooling (static magnetic field magnetization method) and the pulse magnetization method. In regard to the a magnetic cooling, the samples were disposed within a magnetic field of 3.5 T at room temperature, and then were dipped into liquid nitrogen to cool these, and then external magnetic field was lowered to zero with a demagnetizing rate of 0.5 T/minute. In addition, in regard to the pulse magnetization method, a pulse magnetic field in which a pulse width is substantially 5 ms and a maximum applied magnetic field was 5.0 T was applied with respect to the samples dipped into the liquid nitrogen. In addition, the c-axis direction of the samples was a normal line direction of a hexagonal surface, and the magnetic field was applied parallel to the c-axis.

In the static magnetic field magnetization method, when Sample 5-1 of this example was set as a superconducting bulk magnet, a magnetic field distribution in which the peak magnetic field is 1.75 T and an axial symmetry property of a hexagon is relatively good was obtained. Contrary to this, when Sample 5-2 of the comparative example was set as a superconducting bulk magnet, the peak magnetic field was slightly raised to 1.8 T, but a magnetic flux density distribution (a magnetic field distribution) accompanying four-fold symmetry distortion in a central portion was obtained. In the static magnetic field magnetization method, in the oxide superconducting bulk magnet member in which the gap of the nested structure was formed, a relatively symmetric and uniform magnetic field distribution was obtained compared to the oxide superconducting bulk magnet member not having the nested structure.

In the pulse magnetization method, when Sample 5-1 was set as the superconducting bulk magnet, a magnetic field distribution in which the peak magnetic field is 1.65 T and which has a substantially hexagonal symmetry property was obtained. Contrary to this, when Sample 5-2 was set as the superconducting bulk magnet, a magnetic field distribution with a poor six-fold symmetry property, which has a low peak value of 0.75 T and therefore a low magnetic field in the central portion, and which has four peaks in a direction inclined at an angle of 45° from the a-axis direction, was obtained. From this comparison, it was found that when being magnetized by the pulse magnetization method and being set as the oxide superconducting magnet, the oxide superconducting bulk magnet member having a gap, in which the hexagonal rings are disposed to form the nested structure, is significantly excellent in the magnetization characteristic.

Example 6

A Gd—Dy-based oxide superconductor was prepared by the manufacturing method shown in Example 1, and a Gd-based oxide superconductor was prepared by the manufacturing method shown in Example 4. Furthermore, both the oxide superconductors were processed to have the same shape as Sample A and thereby rings shown in FIG. 6 was prepared. Sample 6-1 that was prepared is an oxide superconducting bulk magnet member in which the oxide bulk materials are alternately changed and disposed similarly to Example 1 in the order of a Gd—Dy-based material, a Gd-based material, a Gd—Dy-based material, a Gd-based material, and a Gd—Dy-based material from an outer side ring toward an inner side ring. Sample 6-2 is an oxide superconducting bulk magnet member having a core (core section), in which the oxide bulk materials are alternately changed and disposed similarly to Example 1 in the order of the Gd-based material, the Gd—Dy-based material, the Gd-based material, the Gd—Dy-based material, the Gd-based material, and the Gd—Dy-based material (core) from the outer side ring toward the inner side ring.

When being magnetized by the static magnetic field magnetization method and being set as the superconducting bulk magnet, both Sample 6-1 and Sample 6-2 had a magnetic field distribution with a good axial symmetry property and the peak magnetic fields of 1.73 T and 1.74 T, respectively. In addition, even when being magnetized by the pulse magnetization method and being set as the superconducting bulk magnets, Sample 6-1 and Sample 6-2 had a magnetic field distribution with a good axial symmetry property and peak magnetic fields of 1.63 T and 1.64 T, respectively.

Example 7

Reagents $RE_2O_3$ (RE represents Gd), $BaO_2$, and CuO, which have purity of 99.9% or more, were mixed in a manner such that a mole ratio of the metallic elements of Gd:Ba:Cu is 10:14:20 (that is, a mole ratio of a 123 phase:a 211 phase of a final structure is 3:1), and thereby a mixed powder was prepared. Furthermore, 0.5 mass % of Pt and 10 mass % of $Ag_2O$ were added to the mixed powder and thereby a mixed powder was prepared. The mixed powders were calcinated at 890° C. for 8 hours. Each of the calcinated powders was filled in a cylindrical metallic mold having an inner diameter of 82 mm, and was molded to have a disk shape having the thickness of substantially 33 mm. In addition, an Sm-based disk-shaped compact and a Yb-based disk-shaped compact, which have a thickness of 4 mm, were prepared using $Sm_2O_3$ and $Yb_2O_3$ as $RE_2O_3$ by the same method as the above-described compacts. Furthermore, each of the compacts was formed by isostatic pressing (compressing) at substantially 100 MPa.

These compacts were disposed inside a furnace in a manner such that each of the compacts is disposed on an aluminum support and stacked in the order of the Sm-based compact, the Yb-based compact, and the Gd-based compact (precursors) from a lower side. A temperature of the precursors was raised to 700° C. within 15 hours in the air, to 1040° C. within 160 hours, and to 1170° C. within 1 hour, and then the precursors were maintained at this temperature for 30 minutes, and the temperature was lowered to 1030° C. within 1 hour and then the precursors were maintained at this temperature for 1 hour. Meanwhile, an Sm-based seed crystal that was prepared in advance was used and the seed crystal was carried onto a semi-molten state precursor. A cleavage plane of the seed crystal was carried onto the precursor in a manner such that a c-axis of the seed crystal matches a normal line of the disk-shaped precursor. Then, the precursors were cooled to a temperature of 1000° C. to 985° C. within 280 hours in the air to promote a crystal growth. Furthermore, the precursors were cooled to room temperature within substantially 35 hours, and thereby a Gd-based oxide superconductor having an outer diameter of substantially 63 mm, and a thickness of substantially 28 mm was obtained. In addition, two of the same Gd-based oxide superconductors were further prepared by the same method, and total three samples (for Sample J, Sample K, and Sample L that are described later) were obtained. These samples had a structure in which the $RE_2BaCuO_5$ phase of substantially 1 μm and the silver of 50 to 500 μm are dispersed within the $REBa_2Cu_3O_{7-x}$ phase.

Figure 10:
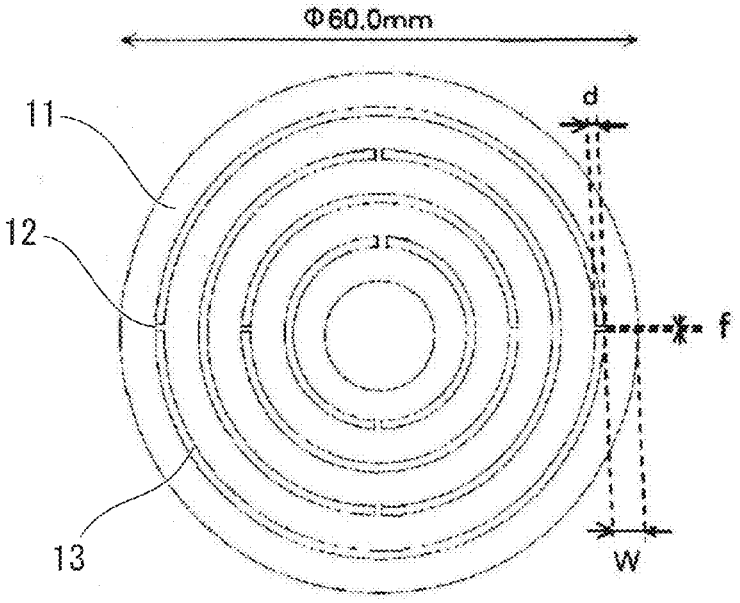
FIG. 10 is a view illustrating a five-fold ring shape having a bridge portion, which is manufactured by Example 7.

Next, Sample J was slice-cut in a thickness of 1.8 mm, and total 11 sheets of wafer-shaped superconductors were prepared. All of the c-axes of the obtained wafers were within ±10° with respect to a normal line of a cut plane. Then, wafer-shaped Sample J was processed to have a shape of a five-fold ring 11 which is provided with a bridge portion and has an outer diameter of 60 mm as shown in FIG. 10 through a sand blasting process. A width dimension W of oxide superconductors (oxide bulks) shown in FIG. 10 was 4.6 mm, a width dimension d of a gap 13 was 0.5 mm, and a width dimension f of a bridge portion 12 was 0.3 mm. The five-fold rings of 11 sheets were laminated and disposed in a stainless ring having an outer diameter of 64.0 mm and an inner diameter of 60.1 mm after an oxygen annealing process, each of the laminated layers and the stainless ring were fixed with an epoxy resin. In this stacking process, each layer was laminated in such a manner that the a-axis was deviated by 10° within a lamination plane in each case. In addition, a ring formed of a GFRP (glass fiber reinforced plastic) having an outer diameter of 10.5 mm was disposed at a central portion and thereby an oxide superconducting bulk magnet member was manufactured. At this time, the time taken for this stacking process was 25 minutes.

In addition, as a comparative example, Sample K was processed to have a disk shape having an outer diameter of 60.0 mm, an inner diameter of 10.5 mm, and a height of 20.0 mm. That is, Sample K that was processed is a monolithic oxide bulk that is not subjected to the above-described slice processing or processing into a ring shape. After being processed, Sample K was subjected to the above-described oxygen annealing process and was disposed within a stainless ring having an outer diameter of 64.0 mm and an inner diameter of 60.1 mm, and then was fixed with the stainless ring and an epoxy resin, and thereby an oxide superconducting bulk magnet member was manufactured. The trapped magnetic field of Sample J was compared with that of Sample K when these samples was magnetized by the static magnetic field magnetization method. In regard to the magnetic cooling, the samples were disposed within a magnetic field of 3.5 T at room temperature, and were cooled to 77 K by liquid nitrogen, and then external magnetic field was lowered to zero with a demagnetizing rate of 0.5 T/minute.

Figure 11A:
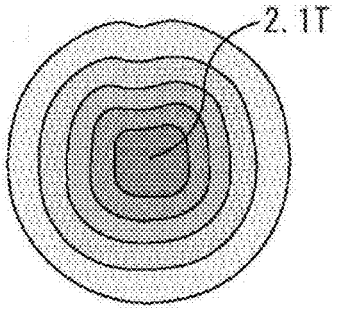
FIG. 11A is a view illustrating a trapped magnetic flux distribution when sample K manufactured by Example 7 is magnetized by the static magnetic field magnetization.
Figure 11B:
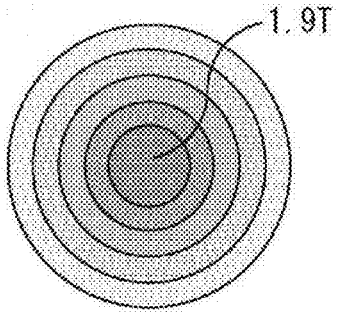
FIG. 11B is a view illustrating a trapped magnetic flux distribution when sample J manufactured by Example 7 is magnetized by the static magnetic field magnetization.

In an oxide superconducting bulk magnet using Sample J of this example, it was confirmed that as shown in FIG. 11B, a uniform magnetic field distribution with a shape of concentric circles, which has a peak magnetic field of 1.9 T, was obtained, and a magnetic field distribution having a significantly improved symmetry property was obtained. On the other hand, an oxide superconducting bulk magnet using Sample K as a comparative example was a monolithic magnet in which the gap due to the nested structure is not formed, such that as shown in FIG. 11A, the peak magnetic field was enlarged by an amount due to the absence of the gap, and therefore a peak magnetic field of 2.1 T was obtained. However, the symmetric and uniform magnetic field was not obtained due to distortion of four-fold symmetry close to a square shape.

Next, the magnetization was performed with respect to these samples by the pulse magnetization method. With respect to samples dipped into liquid nitrogen within a zero magnetic field, a pulse magnetic field of an applied magnetic field of 4 T was applied with a pulse width of 5 ms and then a pulse magnetic field of 5 T was applied. In addition, the c-axis direction of the samples was a normal line direction of a disk surface, and the magnetic field was applied parallel to the c-axis.

Figure 11C:
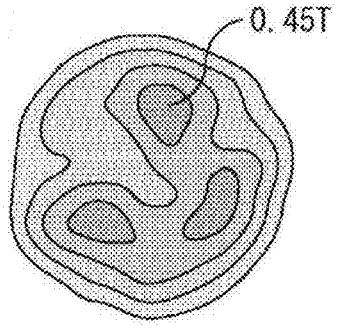
FIG. 11C is a view illustrating a trapped magnetic flux distribution when sample K manufactured by Example 7 is magnetized by the pulse magnetization.
Figure 11D:
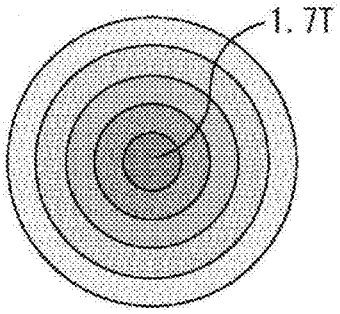
FIG. 11D is a view illustrating a trapped magnetic flux distribution when sample J manufactured by Example 7 is magnetized by the pulse magnetization.

In FIG. 11C, a pulse magnetization result of Sample K after applying a pulse of 5 T is shown. A non-uniform magnetic field distribution with a low symmetry property and peak magnetic field of 0.45 T and a valley was formed in the a-axis direction was obtained. Contrary to this, in Sample J of this example, it was confirmed that as shown in FIG. 11D, a uniform magnetic field distribution with a shape of concentric circles, which has a peak magnetic field of 1.7 T, was obtained, and a magnetic field distribution having a significantly good symmetry property was obtained even when the pulse magnetization method is applied. In addition, in a case where the same pulse magnetization was repeated over 100 times with respect to Sample A, a ratio of a peak magnetic field after performing the pulse magnetization over 100 times with respect to a peak magnetic field at the time of performing the first time pulse magnetization was measured, and as a result thereof, this ratio was 99% and a magnetic performance was rarely lowered.

Next, similarly to Sample J, Sample L was slice-cut in a thickness of 1.8 mm, and total 11 sheets of wafer-shaped superconductors were prepared. All of the c-axes of the obtained wafers were within ±10° with respect to a normal line of a cut plane. Then, wafer-shaped Sample L was processed by a sand blasting process to have a shape of a five-fold ring having an outer diameter of 60 mm as shown in FIG. 6, which is not provided with a bridge portion. In addition, the width dimension W of the superconductors was 4.6 mm, and the width dimension d of a gap was 0.5 mm. Similarly to Sample J, an oxide superconducting bulk magnet member was manufactured using Sample L. At this time, a time to assemble each ring was necessary, and therefore a time necessary for an assembling and stacking process was 70 minutes.

With respect to Sample L from which the oxide superconducting bulk magnet member was manufactured, the same magnetization test as Sample J and Sample K was performed, and in a case where the magnetization was performed by the static magnetic field magnetization method, a magnetic field distribution in which a peak magnetic field was 1.8 T and the peak was slightly deviated from the center was obtained. This is considered because the center of a ring may be deviated due to resin filling at the time of the stacking process. In addition, in a case where the magnetization was performed by the pulse magnetization method, a magnetic field distribution in which a low peak magnetic field of 1.6 T was shown and the peak was slightly deviated from the center similarly to the case of the static magnetic field magnetization was obtained. In addition, in regard to a variation of the peak magnetic field due to a repetitive pulse over 100 times, it is considered that the above-described ratio was 92%, and the peak position was deviated from the center and thereby the magnetic field distribution was non-uniform, such that stress concentration occurs and thereby the oxide superconducting bulk was deteriorated.

In addition, one sheet of wafer before stacking (a five-fold ring which has a thickness: 1.8 mm, a width dimension W: 4.6 mm, a width dimension d of a gap: 0.5 mm, and a width dimension f of a bridge portion: 0.3 mm, and in which a central portion was vacant), which was produced using Sample J, and one sheet of wafer before stacking (a five-fold ring which has a thickness: 1.8 mm, a width dimension W: 4.6 mm, and a width dimension d of a gap: 0.5 mm, and in which the bridge portion was not provided, a gap between rings was fixed by an epoxy resin, and the central portion was vacant), which was produced using Sample L were magnetized by the static magnetic field magnetization method or the pulse magnetization method as described above.

In the case of performing the static magnetic field magnetization, in the wafer of Sample J, a uniform magnetic field distribution having a shape of concentric circles in which the peak magnetic field was 0.6 T was obtained. On the other hand, in the wafer of Sample L, a magnetic field distribution which was deviated from the shape of concentric circles and in which the peak magnetic field was 0.5 T was obtained. This is considered because as described above, the center of the ring was deviated due to the resin filling at the time of the stacking process. In addition, in a case where the magnetization was performed by the pulse magnetization, in the wafer of Sample J, a uniform magnetic field distribution having a shape of concentric circles and the peak magnetic field of 0.5 T was obtained. In addition, in regard to a variation of the peak magnetic field due to a repetitive pulse over 100 times, the above-described ratio was 99% or more, and the peak magnetic field rarely varied. On the other hand, in the wafer of Sample L, a magnetic field distribution, which was deviated from the shape of concentric circles and in which the peak magnetic field was 0.4 T, was obtained. In addition, in regard to a variation of the peak magnetic field due to a repetitive pulse over 100 times, it is considered that the above-described ratio was 93%, and the peak position was deviated from the center and thereby the magnetic field distribution was non-uniform, such that stress concentration occurred and thereby the oxide superconducting bulk was deteriorated.

From the above-described results, when being magnetized by the static magnetic field magnetization, the oxide superconducting bulk magnet member in which the five-fold ring having the bridge portion was disposed to form the nested structure generates a magnetic field that is excellent in a symmetry property and a uniformity, which has a shape of concentric circles, as a superconducting bulk magnet. Furthermore, even when being magnetized by the pulse magnetization, the oxide superconducting bulk magnet member is very excellent in a magnetization characteristic and generates a symmetric and uniform magnetic field as a superconducting bulk magnet. Furthermore, the oxide superconducting bulk magnet member is excellent in manufacturing workability.

Example 8

In regard to an oxide superconducting bulk having a shape of concentric circles, each oxide superconducting bulk magnet member was manufactured by changing conditions such as the number of bridge portions per circumference of a circle, a width dimension in a direction orthogonal to an axis (rotational symmetry axis), a thickness in an axial direction, the number of stacked sheets in an axial direction, whether or not a resin, grease, and solder is present, a deviation of the c-axis with respect to the rotational symmetry axis, and a mutual displacement of the a-axis on the basis of the oxide superconducting bulk magnet member and the manufacturing method thereof of Example 7. With respect to the oxide superconducting bulk magnet members, a stacking process time, evaluation about a peak value, a uniformity, and a symmetry property of a magnetic field distribution at the time of the static magnetic field magnetization, evaluation about a peak value, a uniformity, and a symmetry property of a magnetic field distribution at the time of the pulse magnetization, and a ratio of a peak value (a peak magnetic field) after performing the pulse magnetization over 100 times with respect to a peak value at the time of performing the first time pulse magnetization are shown in Table 3 described below. In addition, in Table 3, Samples J to L of Example 7 are indicated by sample numbers 7-1 (Sample J), 7-2 (Sample K), and 7-3 (Sample L).

TABLE 3

| Sample No. | Outermost Diameter/ Minimum Inner Diameter (mm) | Number of Layers | Number of Bridge Portions per Circumference of Circle | Width in Direction Orthogonal to Axis (mm) | Thickness in Direction of Axis (mm) | Number of Layers in Direction of Axis | Resin, Grease, Solder, or None | Thickness of SUS Ring for Support (mm) | Deviation of c-axis (±°) |
|---|---|---|---|---|---|---|---|---|---|
| 7-1 | 60/10.6 | 5 | 2 | 4.6 | 1.8 | 11 | Resin | 2 | 10 or less |
| 7-2 | 60/10.5 | 1 | 0 | 25 | 20 | 1 | None | 2 | 10 or less |
| 7-3 | 60/10.6 | 5 | 0 | 4.6 | 1.8 | 11 | Resin | 2 | 10 or less |
| 8-1 | 60/10.6 | 5 | 1 | 4.6 | 1.8 | 11 | Resin | 2 | 10 or less |
| 8-2 | 60/0 | 6 | 2 | 4.6 | 1.8 | 11 | Grease | 2 | 10 or less |
| 8-3 | 60/0 | 5 | 1 | 4.6 | 1.8 | 11 | Resin | 2 | 10 or less |
| 8-4 | 60/0 | 6 | 0 | 4.6 | 1.8 | 11 | Grease | 2 | 10 or less |
| 8-5 | 60/0 | 5 | 1 | 4.6 | 1.8 | 11 | Solder | 2 | 10 or less |
| 8-6 | 60/10.6 | 5 | 2 | 4.6 | 1.8 | 11 | Resin | 2 | 10 or less |
| 8-7 | 60/10.6 | 5 | 0 | 4.6 | 1.8 | 11 | Resin | 2 | 10 or less |
| 8-8 | 60/10.6 | 5 | 2 | 4.6 | 1.8 | 11 | Resin | 2 | 25 or less |
| 8-9 | 60/10.6 | 5 | 8 | 4.6 | 1.8 | 11 | None | 2 | 10 or less |
| 8-10 | 60/10.6 | 5 | 0 | 4.6 | 1.8 | 11 | Resin | 2 | 25 or less |
| 8-11 | 60/10.6 | 2 | 2 | 16 | 1.8 | 11 | Resin | 2 | 10 or less |
| 8-12 | 60/10.6 | 5 | 3 | 4.6 | 1.8 | 11 | Solder | 2 | 10 or less |
| 8-13 | 60/10.6 | 5 | 2 | 4.6 | 1.8 | 11 | Resin | 2 | 35 or less |
| 8-14 | 60/0 | 3 | 1 | 9.5 | 2.5 | 8 | Resin | 2 | 10 or less |
| 8-15 | 60/0 | 3 | 0 | 9.5 | 2.5 | 8 | Resin | 2 | 10 or less |
| 8-16 | 60/10.6 | 5 | 6 | 4.6 | 1.8 | 11 | Resin | 2 | 10 or less |
| 8-17 | 60/10.6 | 5 | 2 | 4.6 | 5 | 4 | Grease | 1 | 10 or less |
| 8-18 | 60/10.6 | 5 | 0 | 4.6 | 5 | 4 | Grease | 1 | 10 or less |
| 8-19 | 60/10.6 | 5 | 6 | 4.6 | 1.8 | 11 | Solder | 2 | 10 or less |
| 8-20 | 100/0 | 5 | 2 | 9.6 | 2.1 | 9 | Resin | 3 | 13 or less |
| 8-21 | 100/0 | 5 | 0 | 9.6 | 2.1 | 9 | Resin | 3 | 13 or less |
| 8-22 | 100/0 | 5 | 2 | 9.6 | 6.5 | 3 | Resin | 3 | 13 or less |
| 8-23 | 100/0 | 5 | 3 | 9.6 | 6.5 | 4 | Solder | 3 | 13 or less |
| 8-24 | 100/0 | 5 | 0 | 9.6 | 6.5 | 3 | Resin | 3 | 13 or less |

| Sample No. | Displacement of a-axis (°) | Time Necessary for Assembling Process (min.) | Peak value in Static Magnetic Field Magnetization (T)/ Uniformity and Symmetry Property in Magnetic Field Distribution | Peak value in Pulse Magnetization (T)/ Uniformity and Symmetry Property in Magnetic Field Distribution | Percentage of Peak Magnetic Field after Pulse Magnetization over 100 Times to Peak Magnetization in First Pulse Magnetization (%) |
|---|---|---|---|---|---|
| 7-1 | 5 | 25 | 1.9/Excellent | 1.7/Excellent | 99 |
| 7-2 | 0 | 0 | 2.1/Good | 0.45/Unacceptable | 73 |
| 7-3 | 5 | 70 | 1.8/Good | 1.6/Good | 92 |
| 8-1 | 5 | 25 | 1.9/Excellent | 1.7/Excellent | 99 |
| 8-2 | 5 | 26 | 1.9/Excellent | 1.7/Excellent | 99 |
| 8-3 | 5 | 26 | 1.9/Excellent | 1.7/Excellent | 99 |
| 8-4 | 5 | 72 | 1.8/Good | 1.6/Good | 93 |
| 8-5 | 5 | 29 | 1.9/Excellent | 1.7/Excellent | 98 |
| 8-6 | 0 | 25 | 1.9/Excellent | 1.3/Acceptable | 89 |
| 8-7 | 0 | 80 | 1.8/Good | 1.2/Acceptable | 81 |
| 8-8 | 5 | 25 | 1.7/Good | 1.6/Good | 96 |
| 8-9 | 5 | 25 | 1.9/Excellent | 1.7/Excellent | 85 |
| 8-10 | 5 | 65 | 1.6/Good | 1.5/Good | 83 |
| 8-11 | 5 | 25 | 1.9/Excellent | 1.5/Acceptable | 88 |
| 8-12 | 5 | 25 | 1.9/Excellent | 1.7/Excellent | 98 |
| 8-13 | 5 | 25 | 1.1/Good | 0.9/Acceptable | 82 |
| 8-14 | 5 | 20 | 1.9/Excellent | 1.7/Excellent | 99 |
| 8-15 | 5 | 55 | 1.8/Good | 1.6/Good | 93 |
| 8-16 | 5 | 19 | 1.9/Excellent | 1.7/Excellent | 99 |

TABLE 3-continued

| | | | | | |
|---|---|---|---|---|---|
| 8-17 | 8 | 15 | 1.9/Excellent | 1.7/Excellent | 99 |
| 8-18 | 8 | 43 | 1.8/Good | 1.6/Good | 91 |
| 8-19 | 10 | 23 | 1.9/Excellent | 1.6/Good | 97 |
| 8-20 | 10 | 35 | 2.6/Excellent | 2.3/Excellent | 98 |
| 8-21 | 10 | 105 | 2.4/Excellent | 2.3/Excellent | 91 |
| 8-22 | 10 | 15 | 2.7/Excellent | 2.4/Good | 95 |
| 8-23 | 10 | 18 | 2.6/Excellent | 2.3/Good | 97 |
| 8-24 | 10 | 40 | 2.4/Good | 2.0/Acceptable | 98 |

From results of Table 3, it was found that the oxide superconducting bulk magnet member using the oxide bulk that was disposed to form the nested structure and had a bridge portion was excellent as the oxide superconducting bulk magnet when the pulse magnetization was performed.

Example 9

Reagents $Gd_2O_3$, $Dy_2O_3$, $BaO_2$, and CuO, which have purity of 99.9% or more, were mixed in a manner such that a mole ratio of the metallic elements of Gd:Dy:Ba:Cu is 9:1:14:20 (that is, a mole ratio of a 123 phase:a 211 phase of a final structure is 3:1), and thereby a mixed powder was prepared. Furthermore, 1.5 mass % of $BaCeO_3$ and 12 mass % of $Ag_2O$ were added to the mixed powder and thereby a mixed powder was prepared. The mixed powders were calcinated at 880° C. for 8 hours. Each of the calcinated powders was filled in a cylindrical metallic mold having an inner diameter of 110 mm, and was molded to have a disk shape having the thickness of substantially 35 mm. In addition, an Sm-based disk-shaped compact and a Yb-based disk-shaped compact, which have a thickness of 4 mm, were prepared using $Sm_2O_3$ and $Yb_2O_3$ as $RE_2O_3$ by the same method as the compacts. Furthermore, each of the compacts was formed by isostatic pressing (compressing) at substantially 100 MPa.

These compacts were disposed inside a furnace in a manner such that each of the compacts is disposed on an aluminum support and stacked in the order of the Sm-based compact, the Yb-based compact, and the Gd—Dy-based compact (precursors) from a lower side. A temperature of the precursors was raised to 700° C. within 15 hours in the air, to 1040° C. within 40 hours, and to 1170° C. within 1 hour, and then the precursors were maintained at this temperature for 30 minutes, and the temperature was lowered to 1030° C. within 1 hour and then the precursors were maintained at this temperature for 1 hour. Meanwhile, an Sm-based seed crystal that was prepared in advance was used and the seed crystal was carried onto a semi-molten state precursor. A cleavage plane of the seed crystal was carried onto the precursor in a manner such that a c-axis of the seed crystal matches a normal line of the disk-shaped precursor. Then, the precursors were cooled to a temperature of 1000° C. to 980° C. within 290 hours in the air to promote a crystal growth. Furthermore, the precursors were cooled to room temperature within substantially 35 hours, and thereby a Gd—Dy-based oxide superconductor having an outer diameter of substantially 85 mm, and a thickness of substantially 29 mm was obtained. In addition, two of the same Gd—Dy-based oxide superconductors were further prepared by the same method, and total three samples (for Sample M, Sample N, and Sample O that are described later) were obtained. These samples had a microstructure in which the $(Gd—Dy)_2BaCuO_5$ phase of substantially 1 μm and the silver of 50 to 500 μm are dispersed within the (Gd—Dy) $Ba_2Cu_3O_{7-x}$ phase.

Figure 12:
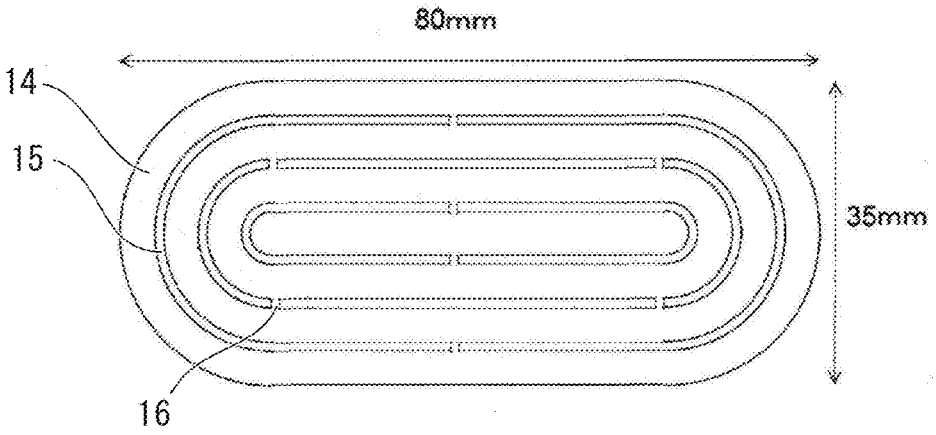
FIG. 12 is a view illustrating a racetrack shape provided with a bridge portion, which is manufactured by Example 9.
Figure 13:
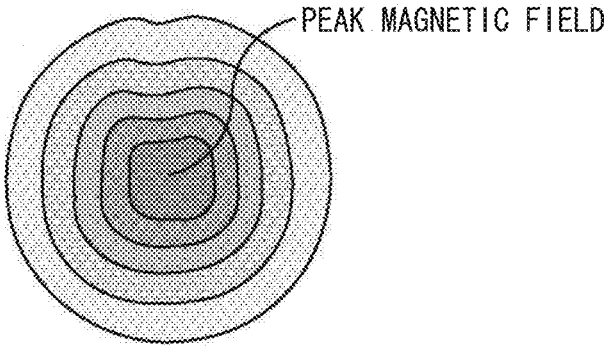
FIG. 13 is a view illustrating a trapped magnetic flux distribution of an oxide superconducting bulk magnet member that is facet-grown in the conventional techniques.

Sample M was slice-cut in a thickness of 2.0 mm, and total 9 sheets of wafer-shaped oxide superconductors were prepared. Then, wafer-shaped Sample M was processed into an oxide superconducting bulk 14 of a racetrack shape that is provided with a bridge portion 16 and has a length of 80 mm in a longitudinal direction and a length of 35 mm in a width direction as shown in FIG. 12 through a sand blasting process. In FIG. 12, a width dimension of each track of a superconductor was 4.5 mm, a width dimension d of a gap 15 was 0.5 mm, and a width dimension f of the bridge portions 16 was 0.3 mm. At this time, the wafer was cut into a racetrack shape by rotating a normal line of a wafer plane by 10° with respect to an axis. That is, the oxide superconducting bulk 14 was prepared by rotating the a-axis by 10° with respect to a longitudinal direction of the track. Continuously, after an oxygen annealing process, the 9 sheets of racetrack-shaped oxide superconductors (oxide bulks) were disposed within a stainless ring having a length of 84 mm in a longitudinal direction, a length of 39 mm in a width direction, and a thickness of 1.9 mm and were fixed by an epoxy resin. A processing time at this time was substantially 30 minutes.

In addition, as a comparative example, a monolithic oxide superconducting bulk, which has no gap and has an outer circumferential shape shown in FIG. 12, that is, a racetrack shape having a length of 80 mm in a longitudinal direction and a length of 35 mm in a width direction, and a thickness of 19.0 mm was cut from a wafer of Sample N. Continuously, the above-described oxygen annealing process was performed, and this oxide superconducting bulk was disposed within a stainless ring having the above-described shape, and was fixed by an epoxy resin.

In addition, as a comparative example, Sample O was slice-cut in a thickness of 2.0 mm, and total 9 sheets of wafer-shaped oxide superconductors were prepared. Then, wafer-shaped sample O was processed into rings and core that have no bridge portion by a sand blast processing to have a racetrack shape having a length of 80 mm in a longitudinal direction, and a length of 35 mm in a width direction, and thereby the oxide bulks were obtained. At this time, the processing was performed without changing a relative position of the cutting so that a longitudinal direction of the racetrack shape matches the a-axis direction of the superconducting wafer (Sample O). Continuously, after the above-described oxygen annealing process, each of the racetrack-shaped oxide superconductors (oxide bulks) were disposed within a stainless ring having the above-described shape, and was fixed by an epoxy resin. In the process of assembling each of the rings and core and of filling the resin, 90 minutes was taken, and it took approximately three times as long to perform the processing compared to the case in which the superconductor having the bridge portion was used, and a position of each superconductor was deviated from a predetermined symmetry position.

With respect to these samples, the magnetization was performed by the magnetization method by a magnetic cooling (static magnetic field magnetization method) and the pulse magnetization. In regard to the magnetization method by a magnetic cooling, the samples were disposed within a magnetic field of 3.5 T at room temperature, and then were dipped into liquid nitrogen within a zero magnetic field to cool them, and then external magnetic field was lowered to zero with a demagnetizing rate of 0.5 T/minute. In addition, in regard to the pulse magnetization method, a pulse magnetic field in which a pulse width is substantially 5 ms and a maximum applied magnetic field was 4.0 T was applied with respect to the samples dipped into the liquid nitrogen. In addition, the c-axis direction of the samples was a normal line direction of a racetrack-shaped plane, and the magnetic field was applied parallel to the c-axis.

In the static magnetic field magnetization method, when Sample M of this example was set as an oxide superconducting bulk magnet, a magnetic field distribution in which the peak magnetic field is 1.1 T and a symmetry property of a racetrack shape is relatively good was obtained. Contrary to this, when Sample N of the comparative example was set as an oxide superconducting bulk magnet, the peak magnetic field was slightly raised to 1.2 T, but a magnetic flux density distribution accompanying distortion in a central portion was obtained. When Sample O was set as the oxide superconducting bulk magnet, the peak magnetic field was 1.0 T, and the symmetry property of the magnetic field distribution was inferior to Sample M provided with the bridge portion, but was slightly superior to Sample N.

In the pulse magnetization method, when Sample M of this example was set as the oxide superconducting bulk magnet, a magnetic field distribution in which the peak magnetic field is 0.95 T and a symmetry property of a racetrack shape is relatively good was obtained. Contrary to this, Sample N of the comparative example was set as the oxide superconducting bulk magnet, a very non-uniform magnetic flux density distribution having a low peak magnetic field of 0.55 T, and five peaks are shown was obtained. When Sample O was set as the oxide superconducting bulk magnet, the peak magnetic field was 0.8, and the symmetry property of the magnetic field distribution was inferior to Sample M provided with the bridge portion, but was superior to Sample N.

From this comparison, it was found that when the oxide superconducting bulk magnet member in which the oxide superconducting bulks of racetrack-shaped rings and core are disposed to form the nested structure and the rings and core are connected by the bridge portions is used as the oxide superconducting bulk magnet after being magnetized by the pulse magnetization method, the magnetization characteristic is significantly superior.

Example 10

Sample P and Sample Q were prepared by the same manufacturing method as Example 7. Sample P and Sample Q were slice-cut in a thickness of 1.5 mm, and 13 sheets of wafer-shaped oxide superconductors for each sample and thereby total 26 sheets of wafer-shaped oxide superconductors were prepared. All of the c-axes of the obtained wafers were within ±10° with respect to a normal line of a cut plane. Then, the 13 sheets of wafers of Sample Q were processed by sand blasting using a mask pattern shown in FIG. 2B, which has a nested shape in which the number of layers of hexagonal ring having a length of one outer circumferential side of substantially 30 mm is 5, a width dimension W is 4.5 mm, and a width dimension of a gap is 0.5 mm, and thereby oxide superconducting bulks were prepared. Next, the 13 sheets of wafers of Sample P were processed by the sand blast to have a five-fold ring shape of a hexagonal shape in which an outer diameter is 60 mm and a bridge portion is provided, using a mask pattern having the same shape as that described above except that the bridge portion is provided at two places for one circumference, and thereby the oxide superconducting bulks were prepared. In addition, the width dimension of the bridge portions was 0.2 mm.

Next, the oxide superconducting bulks processed from Sample P and Sample Q were disposed to form the nested structure after the oxygen annealing process, and the 13 sheets of wafers (layers) of the nested structure were stacked and disposed, within a hexagonal stainless ring having an outer diameter of 64.0 mm, and an inner diameter of 60.1 mm, and then were fixed by an epoxy resin. At this time, in this stacking process, each layer was stacked in a manner such that the a-axis was deviated by 8° in a stacking plane in each case. In addition, at this time, a time necessary for the assembling and stacking process was 25 minutes for Sample P, and 80 minutes for Sample Q.

Next, with respect to the oxide superconducting bulk magnet members processed from Sample P and Sample Q, the static magnetic field magnetization and the pulse magnetization similarly to Example 7 were performed. In addition, in regard to the pulse magnetization, the pulse magnetization was repeated over 100 times, and then a trapped magnetic flux distribution was measured. As a result thereof, in the oxide superconducting bulk magnet member processed from Sample P of this example, a magnetic field distribution in which a peak magnetic field was 1.8 T, and the symmetry property and the uniformity were excellent was obtained by the static magnetic field magnetization. In addition, even when the oxide superconducting magnet member was magnetized by the pulse magnetization method, a magnetic field distribution in which the peak magnetic field was 1.6 T, and the symmetry property and the uniformity were excellent was obtained. Furthermore, the trapped magnetic flux distribution after the pulse magnetization over 100 times also rarely varied from the trapped magnetic flux distribution after the first time pulse magnetization, and the peak magnetic field maintained 98% with respect to the peak magnetic field of the first time.

Contrary to this, in the oxide superconducting bulk magnet member processed from Sample Q, a magnetic field distribution in which the peak magnetic field was 1.5 T, and the position of the peak magnetic field was deviated from the center was obtained by the static magnetic field magnetization. In addition, even when the oxide superconducting magnet member was magnetized by the pulse magnetization method, a magnetic field distribution in which the peak magnetic field was 1.3 T, and the position of the peak magnetic field was deviated from the center was obtained. Furthermore, the peak magnetic field after the pulse magnetization over 100 times was 93% with respect to the peak magnetic field after the first time pulse magnetization and was relatively largely reduced.

From this comparison, in regard to a configuration in which rings having the polygonal shape such as a hexagon are disposed to form the nested structure, even when being magnetized by the static magnetic field magnetization method, the oxide superconducting bulk magnet member having the bridge portion between rings may generate a magnetic field that is excellent in a symmetry property of the hexagonal shape and an uniformity as the oxide superconducting bulk magnet. In addition, when being magnetized by the pulse magnetization method, this oxide superconducting bulk magnet member is highly superior in the magnetization characteristic as the oxide superconducting bulk magnet. Furthermore, the oxide superconducting bulk magnet member is excellent in manufacturing workability at the time of being assembled and stacked.

INDUSTRIAL APPLICABILITY

It is possible to provide an oxide superconducting bulk magnet member that is capable of generating a symmetrical and uniform magnetic field in a strong magnetic field as a superconducting bulk magnet, even when being repetitively magnetized by a pulse magnetization method using an oxide bulk in which an $RE_2BaCuO_5$ phase is dispersed within an $REBa_2Cu_3O_{7-x}$ phase.

REFERENCE SYMBOL LIST

1 to 3: RE-Ba—Cu—O-based oxide bulk (ring-shaped bulk section, ring section)
4: RE-Ba—Cu—O-based oxide bulk (columnar bulk section, core section)
5: Buffer material (interposed section)
8: Gap
9, 12: Bridge portion (interposed section)
10, 13: Gap
11, 14: RE-Ba—Cu—O-based oxide bulk (five-fold ring)
21: Stainless ring (metallic ring)

What is claimed is:

1. An oxide superconducting bulk magnet member comprising:
a plurality of bulk sections that have outer circumferences with outer circumferential dimensions different from each other and are disposed in a manner such that among the outer circumferences, an outer circumference in which the outer circumferential dimension is relatively large surrounds a small outer circumference; and
interposed sections that are disposed between a pair of the bulk sections that are adjacent to each other,
wherein a gap is formed between the bulk sections adjacent to each other,
each of the bulk sections is an oxide bulk in which an $RE_2BaCuO_5$ phase is dispersed within an $REBa_2Cu_3O_{7-x}$ phase,
a bulk section having a smallest outer circumferential dimension among the bulk sections has a columnar shape or a ring shape, and bulk sections other than the bulk section having the smallest outer circumferential dimension have a ring shape, and
the interposed sections are formed of a resin, grease, or solder.

2. The oxide superconducting bulk magnet member according to claim 1, wherein a width dimension of the gap between the pair of the bulk sections that are adjacent to each other is from 0.01 mm to 0.49 mm.

3. The oxide superconducting bulk magnet member according to claim 2,
wherein the pair of the bulk sections that are adjacent to each other are different in an a-axis direction of the $REBa_2Cu_3O_{7-x}$ phase.

4. An oxide superconducting bulk magnet member comprising:
a plurality of bulk sections that have outer circumferences with outer circumferential dimensions different from each other and are disposed in a manner such that among the outer circumferences, an outer circumference in which the outer circumferential dimension is relatively large surrounds a small outer circumference; and
interposed sections that are disposed between a pair of the bulk sections that are adjacent to each other,
wherein a gap is formed between the bulk sections adjacent to each other,
each of the bulk sections is an oxide bulk in which an $RE_2BaCuO_5$ phase is dispersed within an $REBa_2Cu_3O_{7-x}$ phase,
a bulk section having a smallest outer circumferential dimension among the bulk sections has a columnar shape or a ring shape, and bulk sections other than the bulk section having the smallest outer circumferential dimension have a ring shape,
the interposed sections are formed of the oxide bulk to be a bridge portion that connects the pair of the bulk sections that are adjacent to each other, and
a resin, grease, or solder is included in at least a part of the gap.

5. The oxide superconducting bulk magnet member according to claim 4,
wherein a width dimension of the bridge portion along an outer circumference of an inner side bulk section among the pair of bulk sections that are adjacent to each other is 0.1 mm or more, and is 25% or less of the outer circumferential dimension of the outer circumference.

6. The oxide superconducting bulk magnet member according to claim 4,
wherein a thickness dimension of each of the bulk sections in a direction of a rotational symmetry axis is from 1.0 mm to 5.0 mm.

7. The oxide superconducting bulk magnet member according to claim 2 or 4,
wherein a maximum dimension of a width of the ring-shaped bulk sections among the bulk sections in a direction orthogonal to a rotational symmetry axis exceeds 1.0 mm and is 20.0 mm or less.

8. The oxide superconducting bulk magnet member according to claim 2 or 4,
wherein a shape of an inner circumference and a shape of an outer circumference of each of the ring-shaped bulk sections among the bulk sections are a polygonal, circular, or racetrack shape.

9. The oxide superconducting bulk magnet member according to claim 2 or 4,
wherein the bulk sections are stacked to form a plurality of layers in a direction of a rotational symmetry axis.

10. The oxide superconducting bulk magnet member according to claim 9,
wherein a c-axis of the $REBa_2Cu_3O_{7-x}$ phase in each of the layers is within a range of ±30° with respect to the rotational symmetry axis.

11. The oxide superconducting bulk magnet member according to claim 9,
wherein layers, which are adjacent to each other, among the layers is different in an a-axis direction of the $REBa_2Cu_3O_{7-x}$ phase.

* * * * *